US011280191B2

(12) United States Patent
Zuo et al.

(10) Patent No.: US 11,280,191 B2
(45) Date of Patent: Mar. 22, 2022

(54) METHOD FOR CHARACTERIZATION OF HYDROCARBON RESERVOIRS

(71) Applicant: Schlumberger Technology Corporation, Sugar Land, TX (US)

(72) Inventors: Youxiang Zuo, Burnaby (CA); Oliver C. Mullins, Houston, TX (US); Francois Xavier Dubost, Montpellier (FR); Cosan Ayan, Istanbul (TR); Wael Abdallah, Al-Khobar (SA); Andrew E. Pomerantz, Lexington, MA (US); Dingan Zhang, Edmonton (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 811 days.

(21) Appl. No.: 14/373,019

(22) PCT Filed: Jan. 17, 2013

(86) PCT No.: PCT/US2013/021882
§ 371 (c)(1),
(2) Date: Jul. 17, 2014

(87) PCT Pub. No.: WO2013/109716
PCT Pub. Date: Jul. 25, 2013

(65) Prior Publication Data

US 2015/0006084 A1 Jan. 1, 2015

Related U.S. Application Data

(60) Provisional application No. 61/587,846, filed on Jan. 18, 2012.

(51) Int. Cl.

| | |
|---|---|
| ***E21B 49/08*** | (2006.01) |
| ***E21B 49/00*** | (2006.01) |
| ***E21B 49/02*** | (2006.01) |

(52) U.S. Cl.
CPC ..... *E21B 49/088* (2013.01); *E21B 49/00* (2013.01); *E21B 49/02* (2013.01); *E21B 49/08* (2013.01); *E21B 49/0875* (2020.05)

(58) Field of Classification Search
CPC ..... E21B 49/00; E21B 49/02; E21B 49/088; E21B 2049/085
See application file for complete search history.

(56) References Cited

U.S. PATENT DOCUMENTS

| | | | |
|---|---|---|---|
| 4,994,671 | A | 2/1991 | Safinya et al. |
| 7,081,615 | B2 | 7/2006 | Betancourt et al. |

(Continued)

FOREIGN PATENT DOCUMENTS

| | | | |
|---|---|---|---|
| RU | 2315180 | C2 | 1/2008 |
| WO | 2008021743 | A2 | 2/2008 |

(Continued)

OTHER PUBLICATIONS

International Preliminary Report on Patentability issued in the related PCT application PCT/US2013/021882, dated Jul. 22, 2014 (7 pages).

(Continued)

*Primary Examiner* — John E Breene
*Assistant Examiner* — Liam R Casey
(74) *Attorney, Agent, or Firm* — Trevor G. Grove

(57) ABSTRACT

A methodology that performs fluid sampling within a wellbore traversing a reservoir and fluid analysis on the fluid sample(s) to determine properties (including asphaltene concentration) of the fluid sample(s). At least one model is used to predict asphaltene concentration as a function of location in the reservoir. The predicted asphaltene concentrations are compared with corresponding concentrations measured by the fluid analysis to identify if the asphaltene of the fluid sample(s) corresponds to a particular asphaltene type (e.g., (Continued)

asphaltene clusters common in heavy oil). If so, a viscosity model is used to derive viscosity of the reservoir fluids as a function of location in the reservoir. The viscosity model allows for gradients in the viscosity of the reservoir fluids as a function of depth. The results of the viscosity model (and/or parts thereof) can be used in reservoir understanding workflows and in reservoir simulation.

25 Claims, 9 Drawing Sheets

(56) References Cited

U.S. PATENT DOCUMENTS

| | | | | |
|---|---|---|---|---|
| 7,526,953 | B2 | 5/2009 | Goodwin et al. | |
| 7,822,554 | B2 | 10/2010 | Zuo et al. | |
| 7,920,970 | B2 | 4/2011 | Zuo et al. | |
| 7,996,154 | B2 | 8/2011 | Zuo et al. | |
| 8,271,248 | B2 | 9/2012 | Pomerantz et al. | |
| 2004/0041562 | A1* | 3/2004 | Speier | G01V 3/32 324/303 |
| 2007/0168170 | A1* | 7/2007 | Thomas | E21B 43/00 703/10 |
| 2008/0040086 | A1 | 2/2008 | Betancourt et al. | |
| 2009/0248310 | A1* | 10/2009 | Zuo | E21B 47/102 702/11 |
| 2009/0312997 | A1 | 12/2009 | Freed et al. | |
| 2010/0012331 | A1* | 1/2010 | Larter | C09K 8/58 166/401 |
| 2011/0088949 | A1* | 4/2011 | Zuo | E21B 49/08 175/48 |
| 2011/0246143 | A1 | 10/2011 | Pomerantz et al. | |
| 2012/0232859 | A1 | 9/2012 | Pomerantz et al. | |
| 2012/0296617 | A1 | 11/2012 | Zuo et al. | |
| 2013/0275106 | A1* | 10/2013 | Li | G01V 11/00 703/10 |

FOREIGN PATENT DOCUMENTS

| | | | |
|---|---|---|---|
| WO | 2009138911 | A2 | 11/2009 |
| WO | 2011007268 | A1 | 1/2011 |
| WO | 2011030243 | A1 | 3/2011 |
| WO | 2011138700 | A2 | 11/2011 |
| WO | 2012042397 | A2 | 4/2012 |

OTHER PUBLICATIONS

N. Lindeloff et al., The corresponding states viscosity model applied to Heavy Oil systems, Sep. 30, 2004, pp. 17-53.

Decision of Grant issued in the related RU application 2014133716 dated Jan. 1, 2017 (22 pages).

Pedersen, et al., "Viscosity of crude oils", Jan. 1, 1984, Chemical Engineering Science, vol. 39, No. 6, pp. 1011-1016.

European Search Report issued in related EP application 13738343.6 on Jun. 13, 2016, 5 pages.

Office Action issued in related RU application 2014133716 on Oct. 19, 2015, 4 pages.

Aasberg-Petersen, et al. "Prediction of the Viscosities of Hydrocarbon Mixtures," Fluid Phase Equilibria, 70, 1991, pp. 293-308.

Almehaideb et al. "EOS tuning to model full field crude oil properties using multiple well fluid PVT analysis," Journal of Petroleum Science and Engineering, vol. 26, Issues 1-4, pp. 291-300, 2000.

Betancourt, et al. "Predicting Downhole Fluid Analysis Logs to Investigate Reservoir Connectivity," IPTC 11488, presented at International Petroleum Technology Conference in Dubai, U.A.E., Dec. 4-6, 2007, pp. 1-11.

Diallo, et al. "Chapter 5—Thermodynamic Properties of Asphaltenes: A Predictive Approach Based on Computer Assisted Structure Elucidation and Atomistic Simulations," Yen, T.F., and Chilingarian, G.V., eds., Asphaltenes and Asphalts. 2. Developments in Petroleum Science, 40 B, Elsevier Science B.V., (2000), pp. 103-127.

Gonzalez, et al. "Prediction of Asphaltene Instability under Gas Injection with the Pc-Sah I Equation of State," Energy & Fuels, 19, pp. 1230-1234 (2005).

Guo, et al. "Viscosity Models Based on Equations of State for Hydrocarbon Liquids and Gases," Fluid Phase Equilibria, 139, 1997, pp. 405-421.

Hildebrand, et al. "Chapter XXIII, Evaluation of Solubility Parameters," The Solubility of Nonelectrolytes, 3rd ed., Reinhold, New York, 1950, pp. 424-434.

Hirschberg, et al. "Influence of Temperature and Pressure on Asphaltene Flocculation," 1984. Society of Petroleum Engineers of AIME, 24, pp. 283-293.

Indo, et al. "Asphaltene Nanoaggregates Measured in a Live Crude Oil by Centrifugation," Energy & Fuels, 2009, 23, pp. 4460-4469.

Khan, et al. "Viscosity Correlations for Saudi Arabian Crude Oils," SPE Paper 15720 presented at the Fifth SPE Middle East Conference held in Manama, Bahrain, Mar. 7-10, 1987, pp. 251-258.

Li "Rapid Flash Calculations for Compositional Simulation," SPE 95732, SPE Reservoir Evaluation and Engineering, Oct. 2006, pp. 521-529.

Lin, et al. "Chapter V, The effects of asphaltenes on the chemical and physical characteristics of asphalt," Sheu and Mullins, editors, Asphaltenes: fundamentals and applications. New York, Plenum Press, 1995, pp. 155-176.

Lohrenz, et al. "Calculating Viscosities of Reservoir Fluids from Their Compositions," Journal of Petroleum Technology, Oct. 1964, pp. 1171-1176.

Luo, et al. "Effects of asphaltene content on the heavy oil viscosity at different temperature," Fuel, 2007, 86, pp. 1069-1078.

Mohammadi, et al. "A Monodisperse Thermodynamic Model for Estimating Asphaltene Precipitation," AIChE Journal, Nov. 2007, vol. 53, No. 11, pp. 2940-2947.

Mooney "The viscosity of a concentrated suspension of spherical particles," J. Colloid Science, 1951, 6, pp. 162-170.

Mullins et al. "Asphaltene Gravitational Gradient in a Deepwater Reservoir as Determined by Downhole Fluid Analysis," SPE 106375, 2007, pp. 1-6.

Pal, et al. "Viscosity/concentration relationships for emulsions," Journal of Rheology, 1989, vol. 33, No. 7, pp. 1021-1045.

Pedersen, et al. "An Improved Corresponding States Model for the Prediction of Oil and Gas Viscosities and Thermal Conductivities," Chem. Eng. Sci., vol. 42, Issue 1, 1987, pp. 182-186.

Peneloux, et al. "A Consistent Correction for Redlich-Kwong-Soave Volumes," Fluid Phase Equilibria, 8, 1982, pp. 7-23.

Peng, etaL "A New Two-Constant Equation of State," Ind. End. Chem. Fundam., vol. 15, No. 1, 1976, pp. 59-64.

Soave "Equilibrium Constants from a Modified Redlich-Kwong Equation of State," Chemical Engineering Science, 1972, vol. 27, pp. 1197-1203.

Speight, et al. "Molecular Models for Petroleum Asphaltenes and Implications for Asphalt Science and Technology," Proceedings of the International Symposium on the Chemistry of Bitumens, 1991, pp. 154-207.

Ting, et al. "Modeling of Asphaltene Phase Behavior with the SAFT Equation of State," Petroleum Science and Technology, vol. 21, Nos. 3-4, pp. 647-661.

Vaidya, et al. "Compressibility of 18 Molecular Organic Solids to 45 kbar," J. Chem. Phys., 1971, vol. 55, No. 3, pp. 978-992.

Vargas, et al. "Development of a General Method for Modeling Asphaltene Stability", Energy & Fuels, 23, 1147-1154 (2009).

Zuo, et al. "Integration of Fluid Log Predictions and Downhole Fluid Analysis", SPE 122562, presented at 2009 SPE Asia Pacific Oil and Gas Conference and Exhibition held in Jakarta, Indonesia, Aug. 4-6, 2009.

Zuo, et al. "Investigation of Formation Connectivity Using Asphaltene Gradient Log Predictions Coupled with Downhole Fluid Analysis," SPE 124264, presented at 2009 SPE Annual Technical Conference and Exhibition held in New Orleans, Louisiana, USA, Oct. 4-7, 2009, pp. 1-11.

(56) References Cited

OTHER PUBLICATIONS

Zuo, et al. "Modeling of Asphaltene Grading in Oil Reservoirs," Natural Resources, 2010, 1, pp. 19-27.
Zuo, et al. "Plus Fraction Characterization and PVT Data Regression for Reservoir Fluids near Critical Conditions," SPE 64520, Presented at SPE Asia Pacific Oil and Gas Conference and Exhibition, Brisbane, Australia, Oct. 16-18, 2000, pp. 1-12.
Zuo, et al. "A Simple Relation between Solubility Parameters and Densities for Live Reservoir Fluids," J. Chem. Eng. Data, 2010, vol. 55, pp. 2964-2969.
EP Article 94(3) issued in related EP application Jul. 14, 2016, 5 pages.
International Search Report for International Application No. PCT/US2013/021882 dated May 8, 2013.
Examination Report issued in the related CA application 2860860, dated Oct. 15, 2018 (4 pages).
Office action issued in the related MX application MX/a/2014/008714 dated Nov. 6, 2018 (8 pages).
Examination Report issued in the related CA application 2860860, dated Jul. 26, 2019 (4 pages).
Office Action received in the counterpart BR application 112014017618.3, dated Feb. 10, 2020 (8 pages).
Office Action received in the BR application 112014017618.3, dated Sep. 14, 2020 (16 pages).

* cited by examiner

METHOD FOR CHARACTERIZATION OF HYDROCARBON RESERVOIRS

BACKGROUND

Field

The present application relates to methods and apparatus for characterizing a hydrocarbon reservoir. More particularly, the present application relates to reservoir architecture understanding, although it is not limited thereto.

Description of Related Art

The statements made herein merely provide information related to the present disclosure and may not constitute prior art, and may describe some embodiments illustrating the invention.

Petroleum consists of a complex mixture of hydrocarbons of various molecular weights, plus other organic compounds. The exact molecular composition of petroleum varies widely from formation to formation. The proportion of hydrocarbons in the mixture is highly variable and ranges from as much as 97% by weight in the lighter oils to as little as 50% in the heavier oils and bitumens. The hydrocarbons in petroleum are mostly alkanes (linear or branched), cycloalkanes, aromatic hydrocarbons, or more complicated chemicals like asphaltenes. The other organic compounds in petroleum typically contain nitrogen, oxygen, and sulfur, and trace amounts of metals such as iron, nickel, copper, and vanadium.

Petroleum is usually characterized by SARA fractionation where asphaltenes are removed by precipitation with a paraffinic solvent and the deasphalted oil separated into saturates, aromatics, and resins by chromatographic separation.

The saturates include alkanes and cycloalkanes. The alkanes, also known as paraffins, are saturated hydrocarbons with straight or branched chains which contain only carbon and hydrogen and have the general formula $C_nH_{2n+2}$. They generally have from 5 to 40 carbon atoms per molecule, although smaller amounts of shorter or longer molecules may be present in the liquid mixture. Further, the gas phase may have many smaller hydrocarbons. The alkanes include methane ($CH_4$), ethane ($C_2H_6$), propane ($C_3H_8$), i-butane ($iC_4H_{10}$), n-butane ($nC_4H_{10}$), i-pentane ($iC_5H_{12}$), n-pentane ($nC_5H_{12}$), hexane ($C_6H_{14}$), heptane ($C_7H_{16}$), octane ($C_8H_{18}$), nonane ($C_9H_{20}$), decane ($C_{10}H_{22}$), hendecane ($C_{11}H_{24}$)—also referred to as endecane or undecane, dodecane ($C_{12}H_{26}$), tridecane ($C_{13}H_{28}$), tetradecane ($C_{14}H_{30}$), pentadecane ($C_{15}H_{32}$) and hexadecane ($C_{16}H_{34}$). The cycloalkanes, also known as napthenes, are saturated hydrocarbons which have one or more carbon rings to which hydrogen atoms are attached according to the formula $C_nH_{2n}$. Cycloalkanes have similar properties to alkanes but have higher boiling points. The cycloalkanes include cyclopropane ($C_3H_6$), cyclobutane ($C_4H_8$), cyclopentane ($C_5H_{10}$), cyclohexane ($C_6H_{12}$), cycloheptane ($C_7H_{14}$), etc.

The aromatic hydrocarbons are unsaturated hydrocarbons which have one or more planar six-carbon rings called benzene rings, to which hydrogen atoms are attached with the formula $C_nH_m$ where n>m. They tend to burn with a sooty flame, and many have a sweet aroma. The aromatic hydrocarbons include benzene ($C_6H_6$) and derivatives of benzene as well as polyaromatic hydrocarbons. In addition, the resins increase the liquid phase dielectric constant further stabilizing the asphaltenes.

Resins are the most polar and aromatic species present in the deasphalted oil and, it has been suggested, contribute to the enhanced solubility of asphaltenes in crude oil by solvating the polar and aromatic portions of the asphaltenic molecules and aggregates.

Asphaltenes are insoluble in n-alkanes (such as n-pentane or n-heptane) and soluble in toluene. The C:H ratio is approximately 1:1.2, depending on the asphaltene source. Unlike most hydrocarbon constituents, asphaltenes typically contain a few percent of other atoms (called heteroatoms), such as sulfur, nitrogen, oxygen, vanadium, and nickel. Heavy oils and tar sands contain much higher proportions of asphaltenes than do medium-API oils or light oils. Condensates are virtually devoid of asphaltenes. As far as asphaltene structure is concerned, experts agree that some of the carbon and hydrogen atoms are bound in ring-like, aromatic groups, which also contain the heteroatoms. Alkane chains and cyclic alkanes contain the rest of the carbon and hydrogen atoms and are linked to the ring groups. Within this framework, asphaltenes exhibit a range of molecular weight and composition. Asphaltenes have been shown to have a distribution of molecular weight in the range of 300 to 1400 g/mol with an average of about 750 g/mol. This is compatible with a molecule containing seven or eight fused aromatic rings, and the range accommodates molecules with four to ten rings.

It is also known that asphaltene molecules aggregate to form nanoaggregates and clusters. The aggregation behavior depends on the solvent type. Laboratory studies have been conducted with asphaltene molecules dissolved in a solvent such as toluene. At extremely low concentrations (below $10^{-4}$ mass fraction), asphaltene molecules are dispersed as a true solution. At higher concentrations (on the order of $10^{-4}$ mass fraction), the asphaltene molecules stick together to form nanoaggregates. These nanoaggregates are dispersed in the fluid as a nanocolloid, meaning the nanometer-sized asphaltene particles are stably suspended in the continuous liquid phase solvent. At even higher concentrations (on the order of $5*10^{-3}$ mass fraction), the asphaltene nanoaggregates form clusters that remain stable as a colloid suspended in the liquid phase solvent. At higher concentrations (on the order of $5*10^{-2}$ mass fraction), the asphaltene clusters flocculate to form clumps (or floccules) which are no longer in a stable colloid and precipitate out of the toluene solvent. In crude oil, asphaltenes exhibit a similar aggregation behavior. However, at the higher concentrations (on the order of $5*10^{-2}$ mass fraction) that cause asphaltene clusters to flocculate in toluene, stability can continue such that the clusters form a stable viscoelastic network in the crude oil. At even higher concentrations, the asphaltene clusters flocculate to form clumps (or floccules) which are no longer in a stable colloid and precipitate out of the crude oil.

Asphaltene content plays an important role in determining the viscosity of heavy oils. Heavy oils are crude oils with high viscosity (typically above 10 cP), and low gravity (typically lower than 22.3° API). Heavy oils generally require enhanced oil recovery processes to overcome their high viscosity. Simulation, planning, and execution of such enhanced oil recovery processes is critically dependent on accurate knowledge of phase behavior and fluid properties, especially viscosity, of these oils under varying pressure and temperature conditions. However, because heavy oil viscosity generally increases exponentially with asphaltene content, many heavy oil reservoirs exhibit an extremely large viscosity variation with depth. Conventional reservoir simulators (such as the ECLIPSE reservoir simulator available from Schlumberger Technology Corporation of Sugar Land, Tex., USA) generally do not take into account the impact of the large viscosity variation with depth in a heavy oil reservoir due to many factors, including:

(1) asphaltene nanocolloidal structures have not been understood throughout until recently with proposal of the Yen-Mullins model of asphaltenes;

(2) a cubic equation of state (EOS) is a variant of the van der Waals EOS which was derived from the ideal gas law and not suited for asphaltenes; and (3) there is no proper way to handle asphaltene clusters in a classical cubic EOS.

Therefore, there is need for methods, workflows, systems, and supporting apparatus for characterizing the fluid properties, particularly viscosity, of heavy oil reservoirs such that classical reservoir simulators can be extended to simulate heavy oil production processes accurately, in particular, by considering asphaltene content and viscosity gradients.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Embodiments are provided that accurately characterize compositional components and fluid properties at varying locations in a reservoir in order to allow for accurate reservoir architecture analysis and reservoir simulation, including predicting the viscosity of reservoir fluids as a function of location in heavy oil reservoirs.

In accord with the present application, a downhole tool located within a wellbore traversing a reservoir acquires one or more samples of the reservoir fluids. The fluid sample(s) is(are) analyzed by fluid analysis (which can be downhole fluid analysis and/or laboratory fluid analysis) to determine properties (including asphaltene concentration) of the fluid sample(s). At least one model is used to predict asphaltene concentration as a function of location in the reservoir. The predicted asphaltene concentrations are compared with corresponding concentrations measured by the fluid analysis to identify if the asphaltene of the fluid sample(s) corresponds to a particular asphaltene type (e.g., asphaltene clusters common in heavy oil). If so, a viscosity model is used to derive viscosity of the reservoir fluids as a function of location in the reservoir. The viscosity model allows for large gradients in the viscosity of the reservoir fluids as a function of depth. The results of the viscosity model (and/or parts thereof) can be used in reservoir understanding workflows and in reservoir simulation.

In one embodiment, the viscosity model is tuned according to the viscosity of a fluid sample measured by fluid analysis.

In yet another embodiment, the viscosity model is realized by a corresponding state principle model of viscosity, wherein the corresponding state principle model of viscosity models viscosity of a mixture (live heavy oil) based upon corresponding states theory to predict viscosity of the mixture as a function of temperature, pressure, composition of the mixture, pseudo-critical properties of the mixture, and the viscosity of a reference substance evaluated at a reference pressure and temperature. The corresponding state principle model of viscosity can have the form:

$$\mu_m(P, T) = \left(\frac{T_{cm}}{T_{co}}\right)^{-\frac{1}{6}}\left(\frac{P_{cm}}{P_{co}}\right)^{\frac{2}{3}}\left(\frac{MW_m}{MW_o}\right)^{\frac{1}{2}}\left(\frac{\alpha_m}{\alpha_o}\right)\mu_0(P_o, T_o)$$

where $\mu_m$ (P, T) is the viscosity of the mixture (live heavy oil);

$\mu_0$ ($P_o$, $T_o$) is the viscosity of the reference fluid at a reference temperature and reference pressure;

$T_{cm}$ is the critical temperature of the mixture (live heavy oil);

$T_{co}$ is the critical temperature of the reference fluid;

$P_{cm}$ is the critical pressure of the mixture;

$P_{co}$ is the critical pressure of the reference fluid;

$MW_m$ is the molecular weight of the mixture; and $MW_o$ is the molecular weight of the reference fluid;

$\alpha_m$ is a parameter for the mixture; and $\alpha_o$ is a parameter for the reference fluid.

At least one pseudo-critical property of the mixture (such as the critical temperature or critical pressure) can be treated as an adjustable parameter of the viscosity model that is tuned by a tuning process according to the viscosity of a fluid sample measured by fluid analysis. The parameter $MW_m$ representing molecular weight of the mixture can be set in a range significantly less than 60,000 g/mol (preferably it is set in a range between 1500 and 3000 g/mol).

Other embodiments of such viscosity models are set forth in detail below.

Additional objects and advantages of the invention will become apparent to those skilled in the art upon reference to the detailed description taken in conjunction with the provided figures.

DETAILED DESCRIPTION

The particulars shown herein are by way of example and for purposes of illustrative discussion of the embodiments of the present application only and are presented in the cause of providing what is believed to be the most useful and readily understood description of the principles and conceptual aspects of the embodiments. In this regard, no attempt is made to show structural details of the embodiments of the present application in more detail than is necessary for the fundamental understanding of such embodiments. Further, like reference numbers and designations in the various drawings indicate like elements.

Figure 1A:
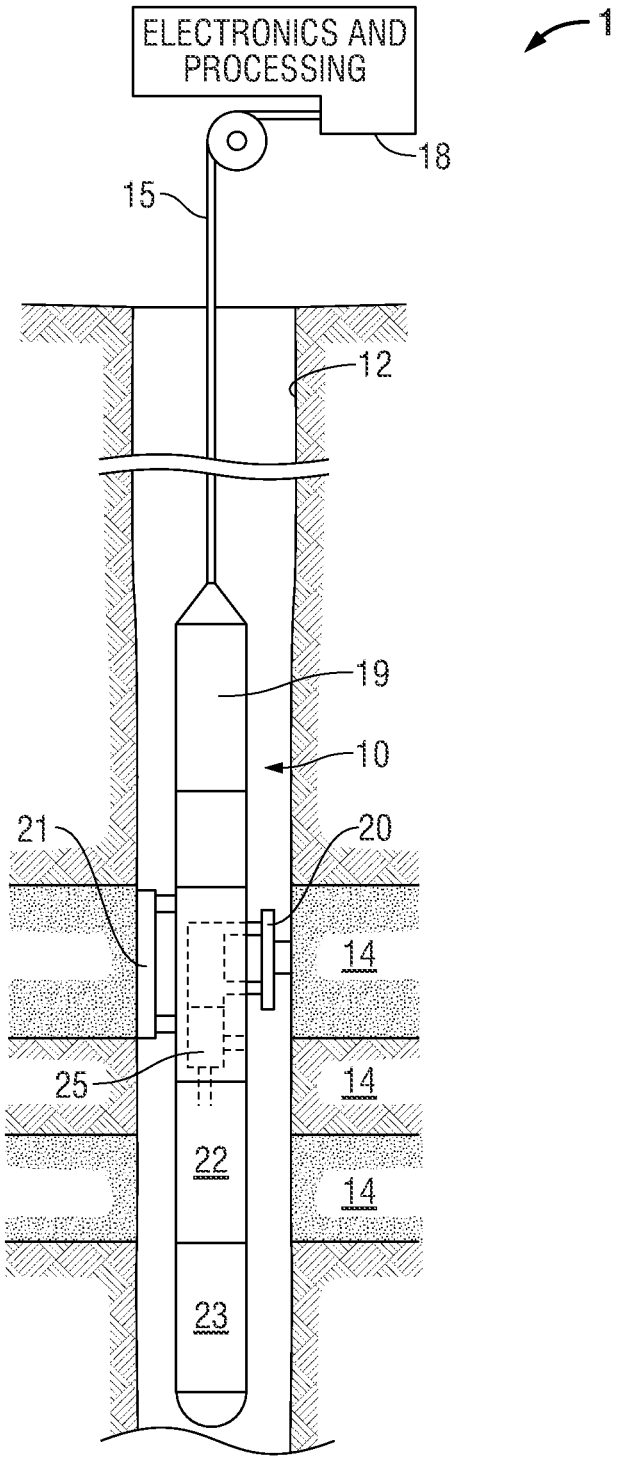
FIG. 1A is a schematic diagram of an exemplary petroleum reservoir analysis system in accordance with the present application.

FIG. 1A illustrates an exemplary petroleum reservoir analysis system 1 in which the present invention is embodied. The system 1 includes a borehole tool 10 suspended in the borehole 12 from the lower end of a typical multiconductor cable 15 that is spooled in a usual fashion on a suitable winch on the formation surface. The cable 15 is electrically coupled to an electrical control system 18 on the formation surface. The borehole tool 10 includes an elongated body 19 which carries a selectively extendable fluid admitting assembly 20 and a selectively extendable tool anchoring member 21 which are respectively arranged on opposite sides of the tool body. The fluid admitting assembly 20 is equipped for selectively sealing off or isolating selected portions of the wall of the borehole 12 such that fluid communication with the adjacent earth formation 14 is established. The fluid admitting assembly 20 and borehole tool 10 include a flowline leading to a fluid analysis module 25. The formation fluid obtained by the fluid admitting assembly 20 flows through the flowline and through the fluid analysis module 25. The fluid may thereafter be expelled through a port or it may be sent to one or more fluid collecting chambers 22 and 23 which may receive and retain the fluids obtained from the formation. With the fluid admitting assembly 20 sealingly engaging the formation 14, a short rapid pressure drop can be used to break the mudcake seal. Normally, the first fluid drawn into the tool will be highly contaminated with mud filtrate. As the tool continues to draw fluid from the formation 14, the area near the fluid admitting assembly 20 cleans up and reservoir fluid becomes the dominant constituent. The time required for cleanup depends upon many parameters, including formation permeability, fluid viscosity, the pressure differences between the borehole and the formation, and overbalanced pressure difference and its duration during drilling. Increasing the pump rate can shorten the cleanup time, but the rate must be controlled carefully to preserve formation pressure conditions.

The fluid analysis module 25 includes means for measuring the temperature and pressure of the fluid in the flowline. The fluid analysis module 25 derives properties that characterize the formation fluid sample at the flowline pressure and temperature. In the one embodiment, the fluid analysis module 25 measures absorption spectra and translates such measurements into concentrations of several alkane components and groups in the fluid sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group, the lump of hexane and heavier alkane components (C6+), and asphaltene content. The C3-C5 alkane group includes propane, butane, and pentane. The C6+ alkane group includes hexane ($C_6H_{14}$), heptane ($C_7H_{16}$), octane ($C_8H_{18}$), nonane ($C_9H_{20}$), decane ($C_{10}H_{22}$), hendecane ($C_{11}H_{24}$)—also referred to as endecane or undecane, dodecane ($C_{12}H_{26}$), tridecane ($C_{13}H_{28}$), tetradecane ($C_{14}H_{30}$), pentadecane ($C_{15}H_{32}$), hexadecane ($C_{16}H_{34}$), etc. The fluid analysis module 25 also provides a means that measures live fluid density ($\rho$) at the flowline temperature and pressure, live fluid viscosity ($\mu$) at flowline temperature and pressure (in cP), formation pressure, and formation temperature.

Control of the fluid admitting assembly 20 and fluid analysis module 25, and the flow path to the collecting chambers 22, 23 is maintained by the control system 18. As will be appreciated by those skilled in the art, the fluid analysis module 25 and the surface-located electrical control system 18 include data processing functionality (e.g., one or more microprocessors, associated memory, and other hardware and/or software) to implement the invention as described herein. The electrical control system 18 can also be realized by a distributed data processing system wherein data measured by the borehole tool 10 is communicated (preferably in real time) over a communication link (typically a satellite link) to a remote location for data analysis as described herein. The data analysis can be carried out on a workstation or other suitable data processing system (such as a computer cluster or computing grid).

Formation fluids sampled by the borehole tool 10 may be contaminated with mud filtrate. That is, the formation fluids may be contaminated with the filtrate of a drilling fluid that seeps into the formation 14 during the drilling process. Thus, when fluids are withdrawn from the formation 14 by the fluid admitting assembly 20, they may include mud filtrate. In some examples, formation fluids are withdrawn from the formation 14 and pumped into the borehole or into a large waste chamber in the borehole tool 10 until the fluid being withdrawn becomes sufficiently clean. A clean sample is one where the concentration of mud filtrate in the sample fluid is acceptably low so that the fluid substantially represents native (i.e., naturally occurring) formation fluids. In the illustrated example, the borehole tool 10 is provided with fluid collecting chambers 22 and 23 to store collected fluid samples.

The system of FIG. 1A is adapted to make in situ determinations regarding hydrocarbon bearing geological formations by downhole sampling of reservoir fluid at one or more measurement stations within the borehole 12, conducting downhole fluid analysis of one or more reservoir fluid samples for each measurement station (including compositional analysis such as estimating concentrations of a plurality of compositional components of a given sample and other fluid properties), and relating the downhole fluid analysis to an equation of state (EOS) model of the thermodynamic behavior of the fluid in order to characterize the reservoir fluid at different locations within the reservoir. With the reservoir fluid characterized with respect to its thermodynamic behavior, fluid production parameters, transport properties, and other commercially useful indicators of the reservoir can be computed.

For example, the EOS model can provide the phase envelope that can be used to interactively vary the rate at which samples are collected in order to avoid entering the two-phase region. In another example, the EOS can provide useful properties in assessing production methodologies for the particular reserve. Such properties can include density, viscosity, and volume of gas formed from a liquid after expansion to a specified temperature and pressure. The characterization of the fluid sample with respect to its thermodynamic model can also be used as a benchmark to determine the validity of the obtained sample, whether to retain the sample, and/or whether to obtain another sample at the location of interest. More particularly, based on the thermodynamic model and information regarding formation pressures, sampling pressures, and formation temperatures, if it is determined that the fluid sample was obtained near or below the bubble line of the sample, a decision may be made to jettison the sample and/or to obtain a sample at a slower rate (i.e., a smaller pressure drop) so that gas will not evolve out of the sample. Alternatively, because knowledge of the exact dew point of a retrograde gas condensate in a formation is desirable, a decision may be made, when conditions allow, to vary the pressure drawdown in an attempt to observe the liquid condensation and thus establish the actual saturation pressure.

Figure 1B:
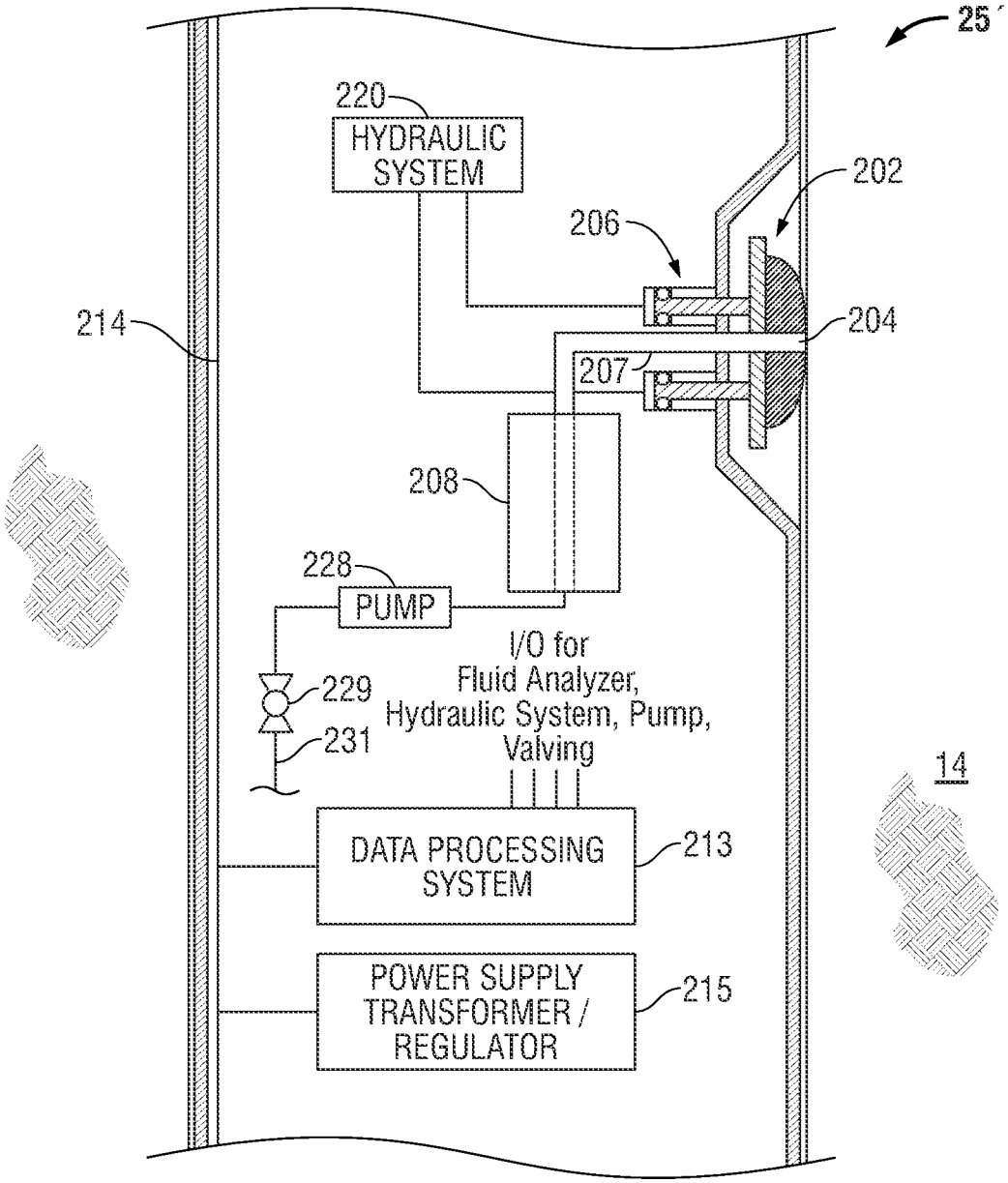
FIG. 1B is a schematic diagram of an exemplary fluid analysis module suitable for use in the borehole tool of FIG. 1A.
Figure 2A:
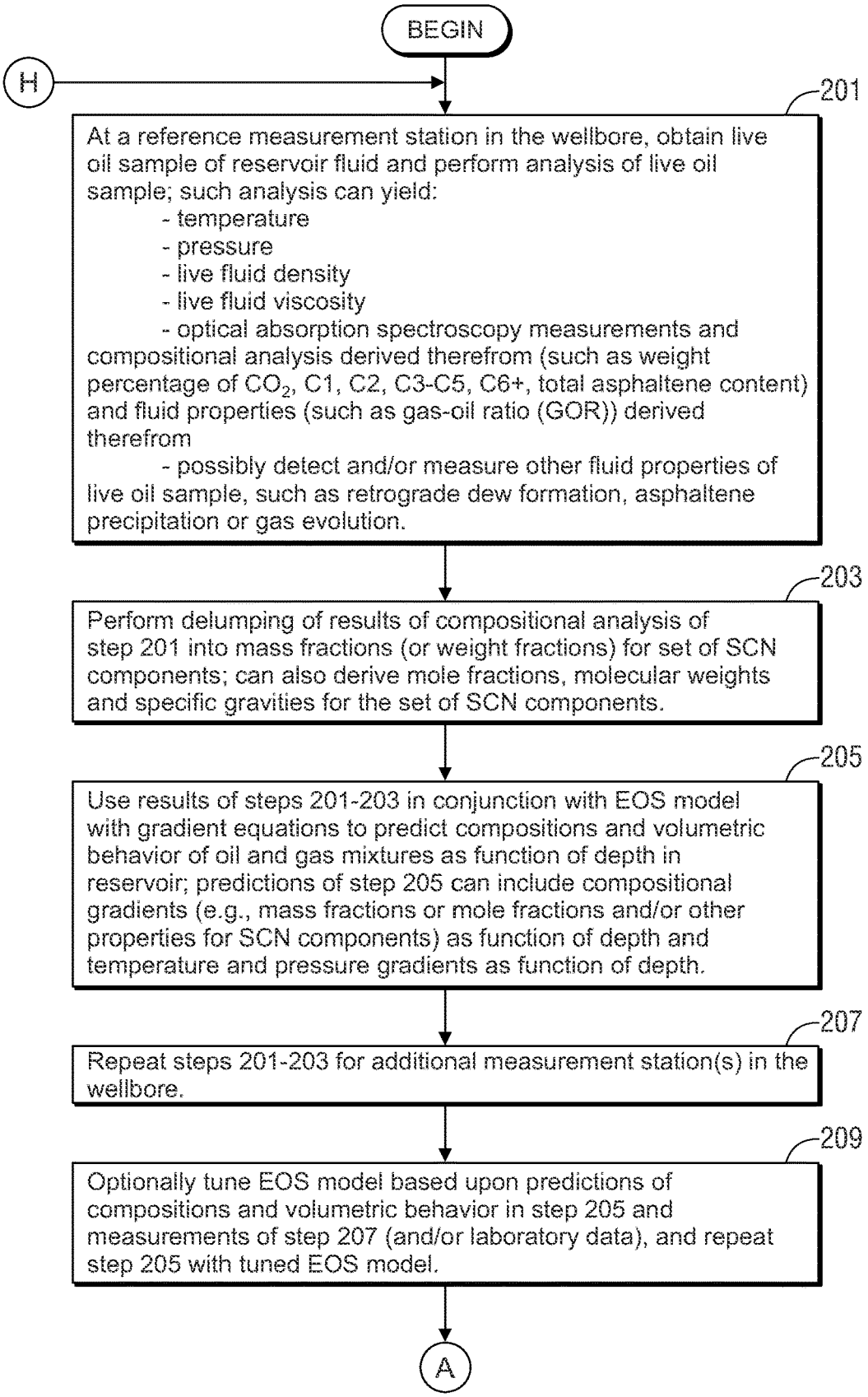
FIGS. 2A-2G, collectively, are a flow chart of data analysis operations that includes downhole fluid measurements at a number of different measurement stations within a wellbore traversing a reservoir or interest in conjunction with at least one solubility model that characterizes the relationship between solvent and solute parts of the reservoir fluids at different measurement stations. The solubility model is used to calculate a predicted value of the relative concentration of the solute part for at least one given measurement station for different solute class types. The predicted solute part concentration values are compared to corresponding solute part concentration values measured by the downhole fluid analysis to determine the best matching solute class type. In the event that the best-matching solute class type corresponds to at least one predetermined asphaltene component (e.g., asphaltene clusters), a viscosity model suitable for heavy oil with large viscosity gradients is used to characterize the viscosity of the oil column for reservoir analysis.
Figure 2B:
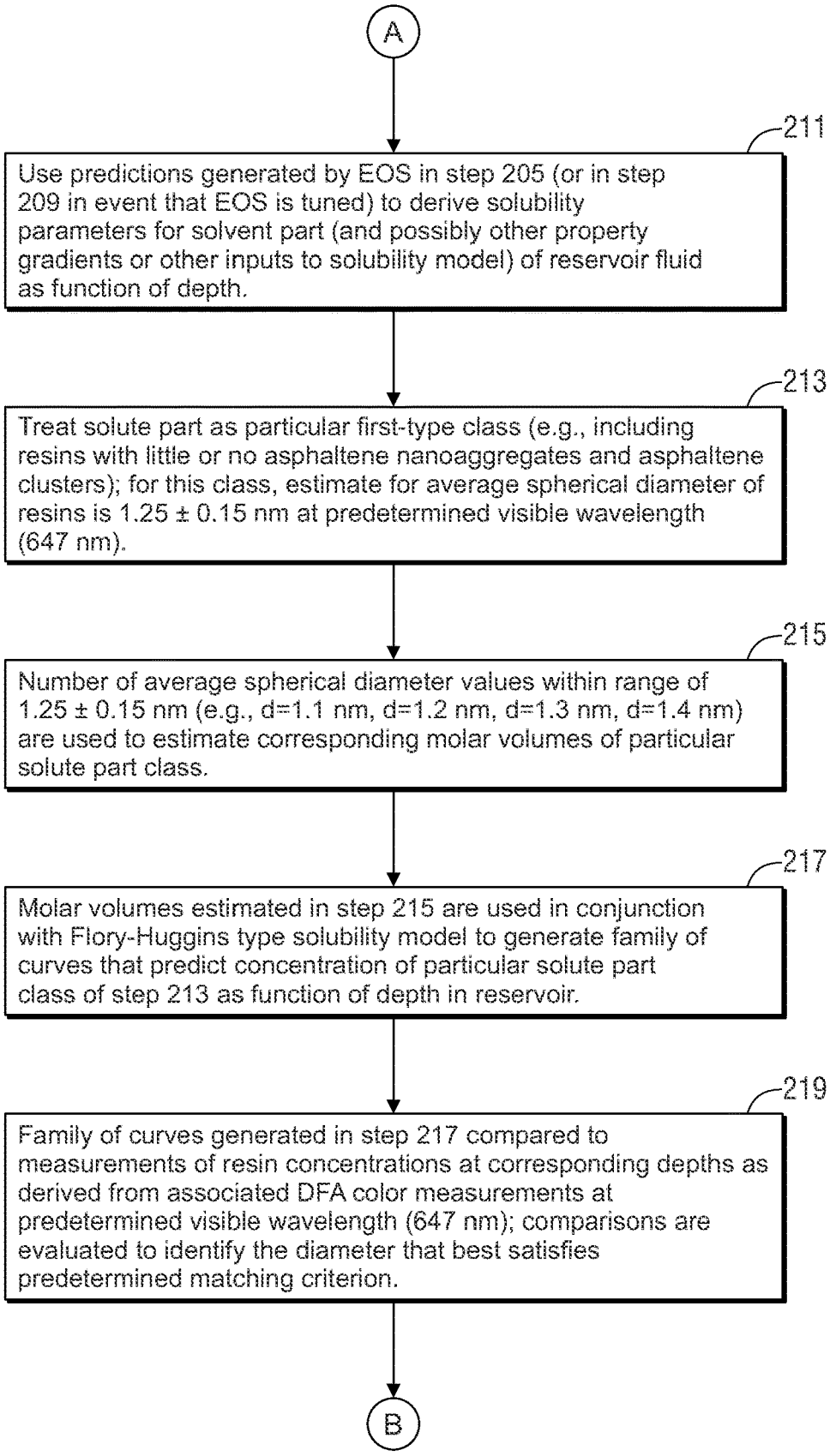
Figure 2C:
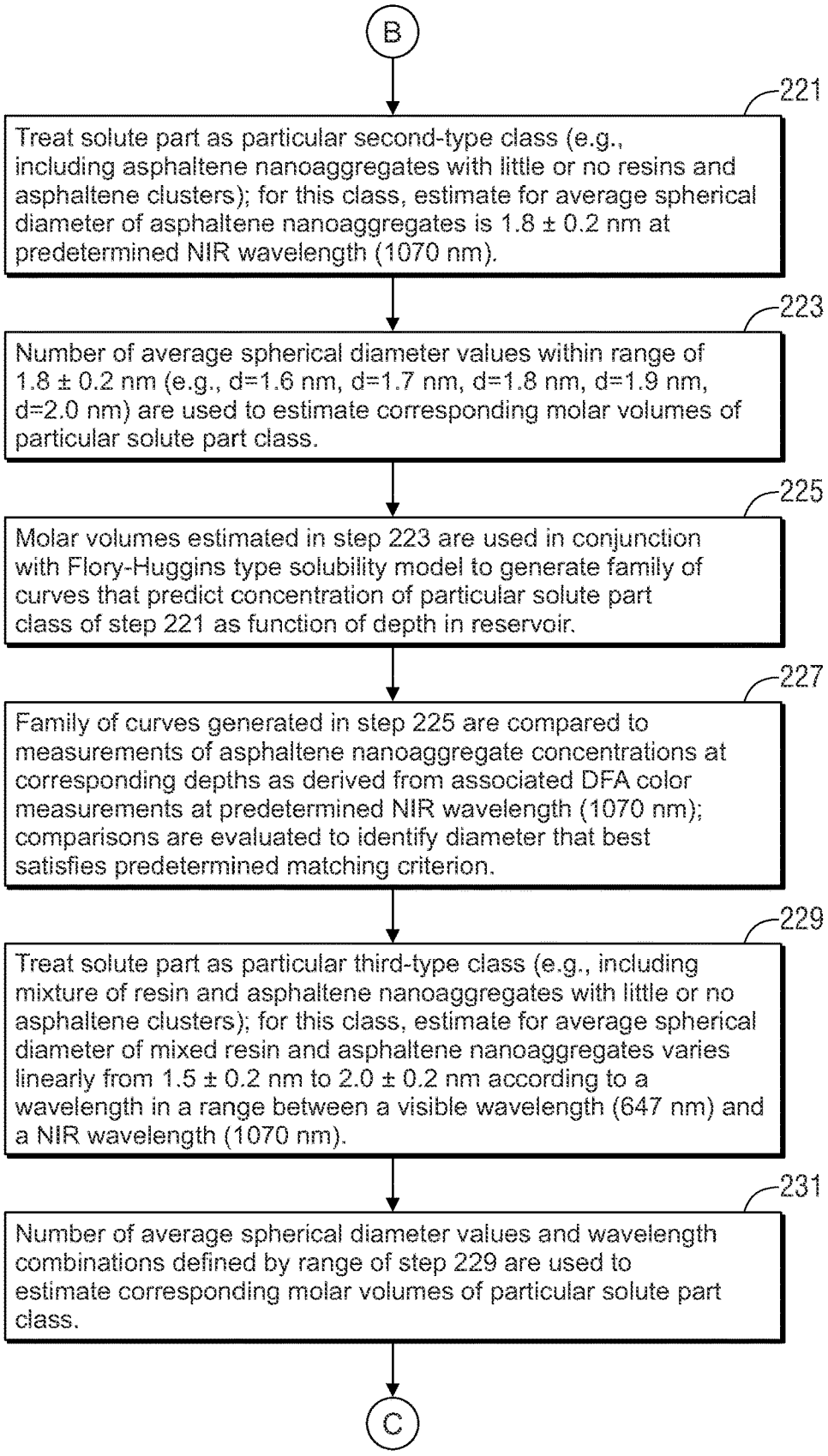
Figure 2D:
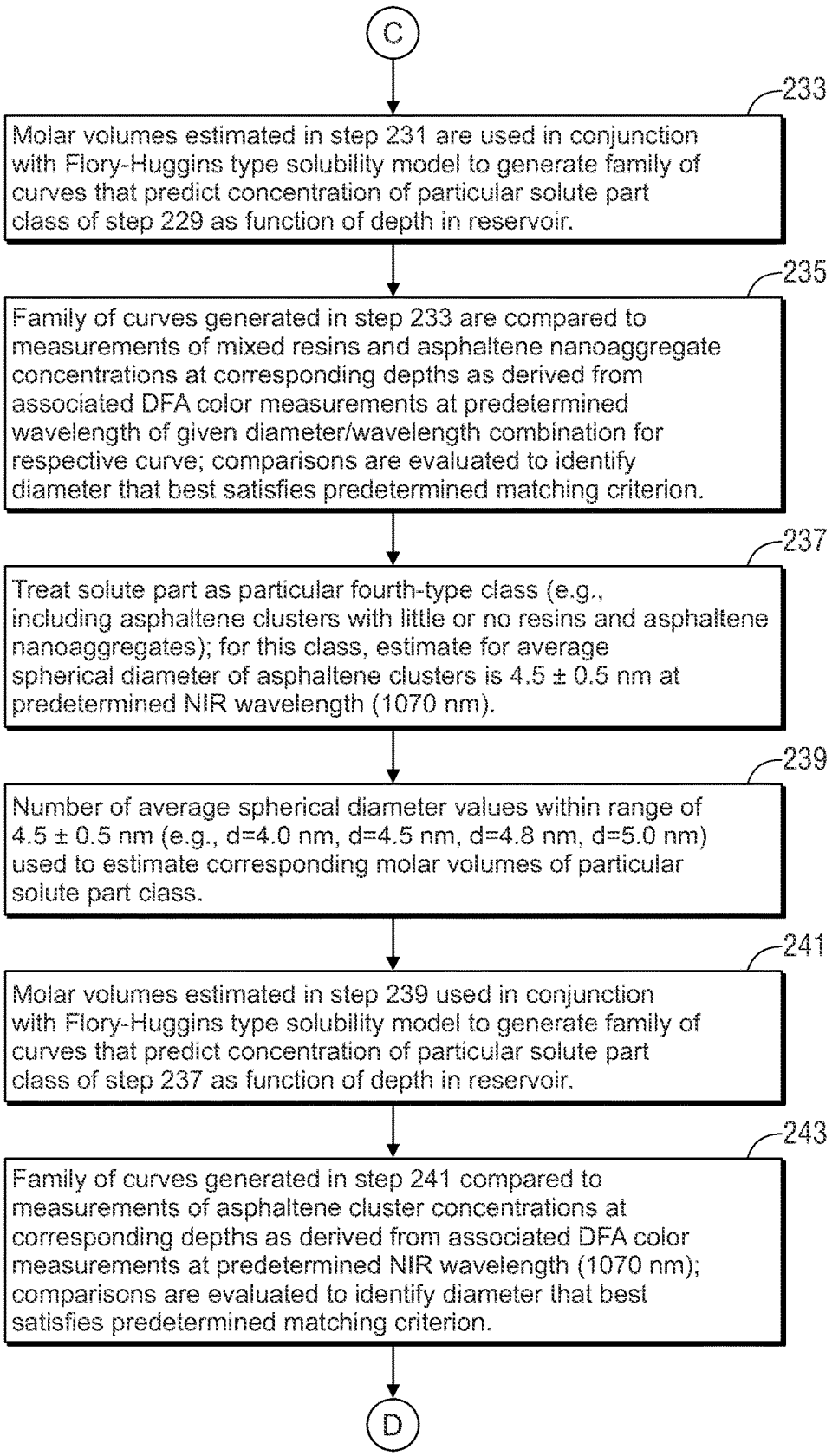
Figure 2E:
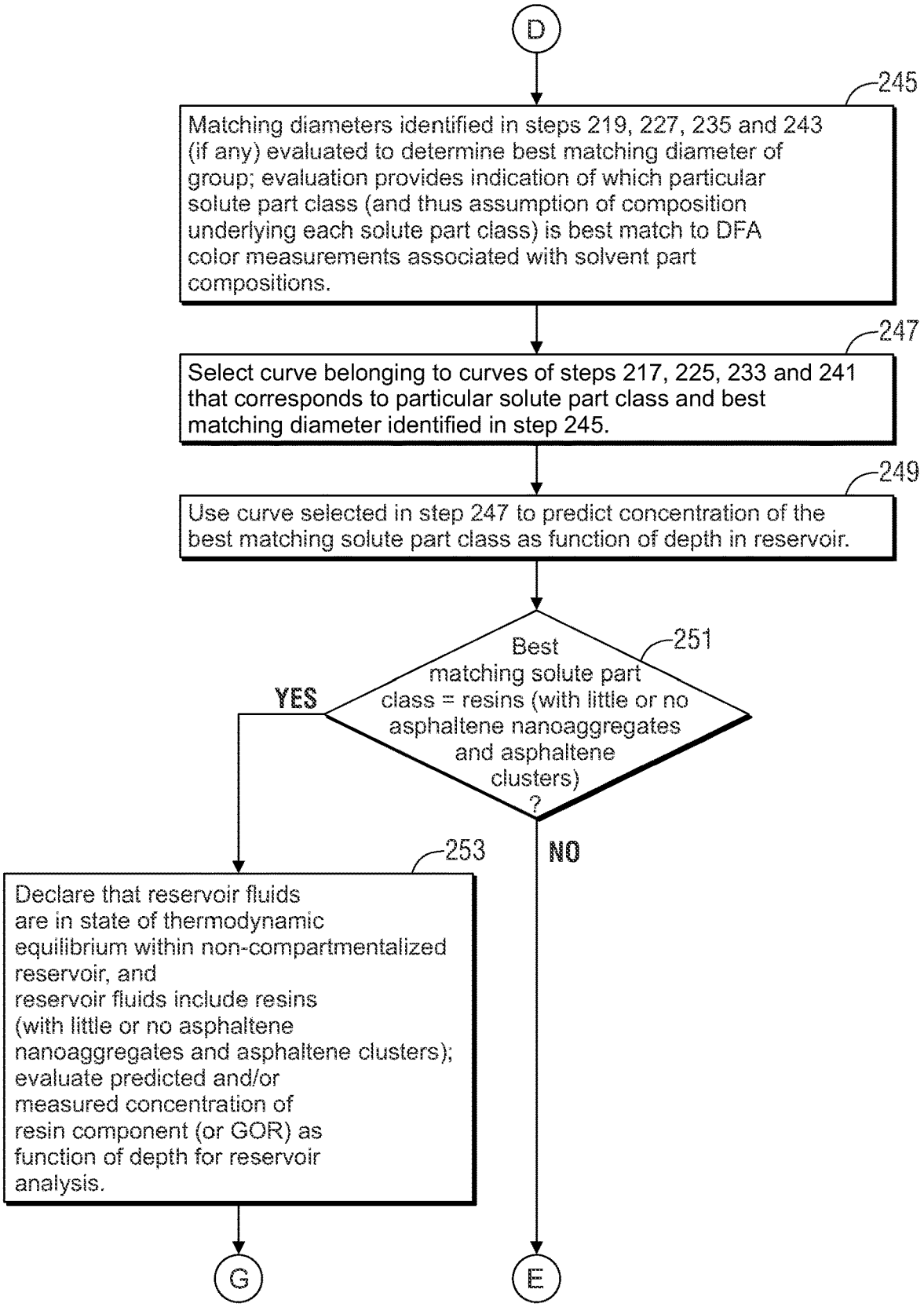
Figure 2F:
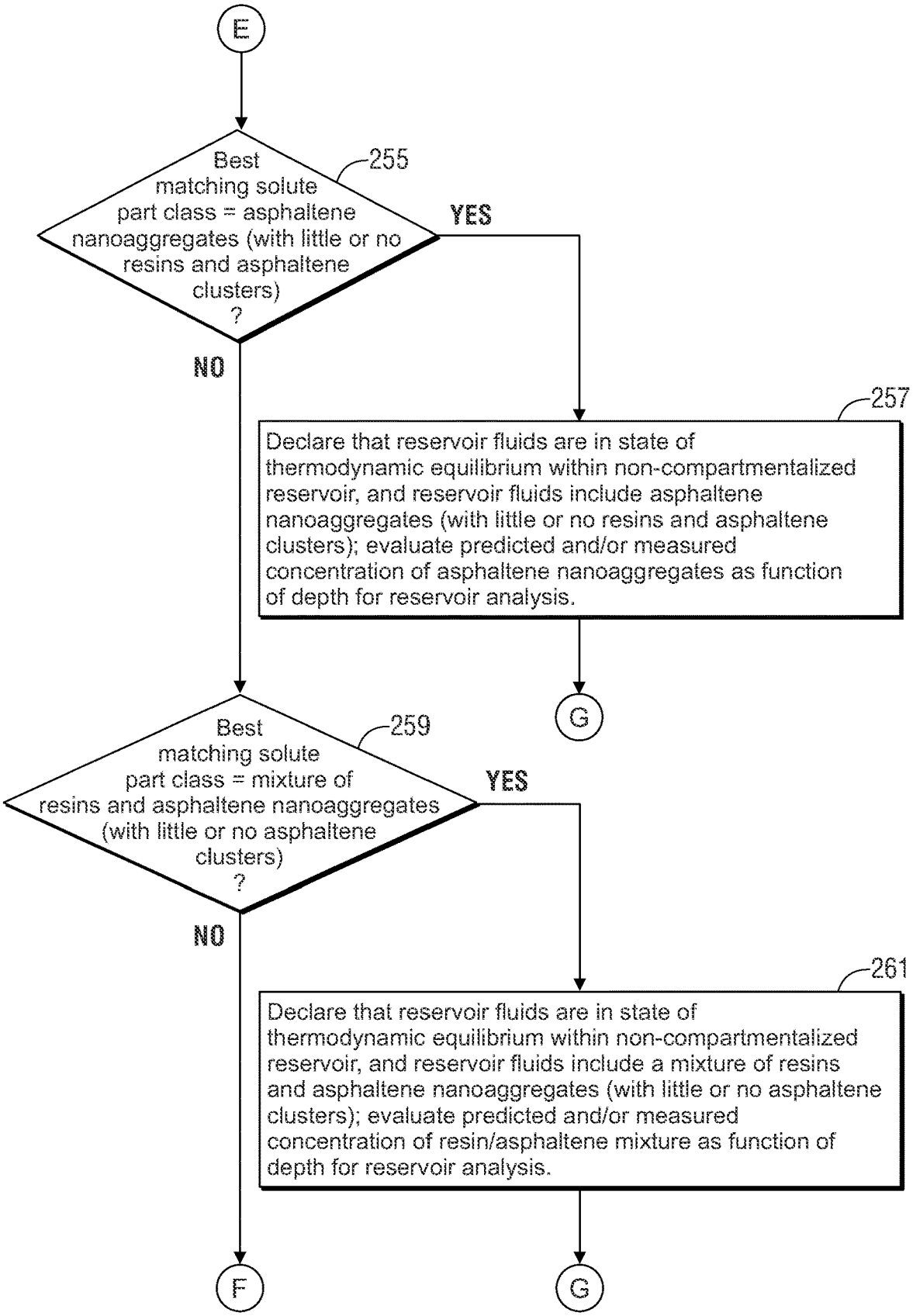
Figure 2G:
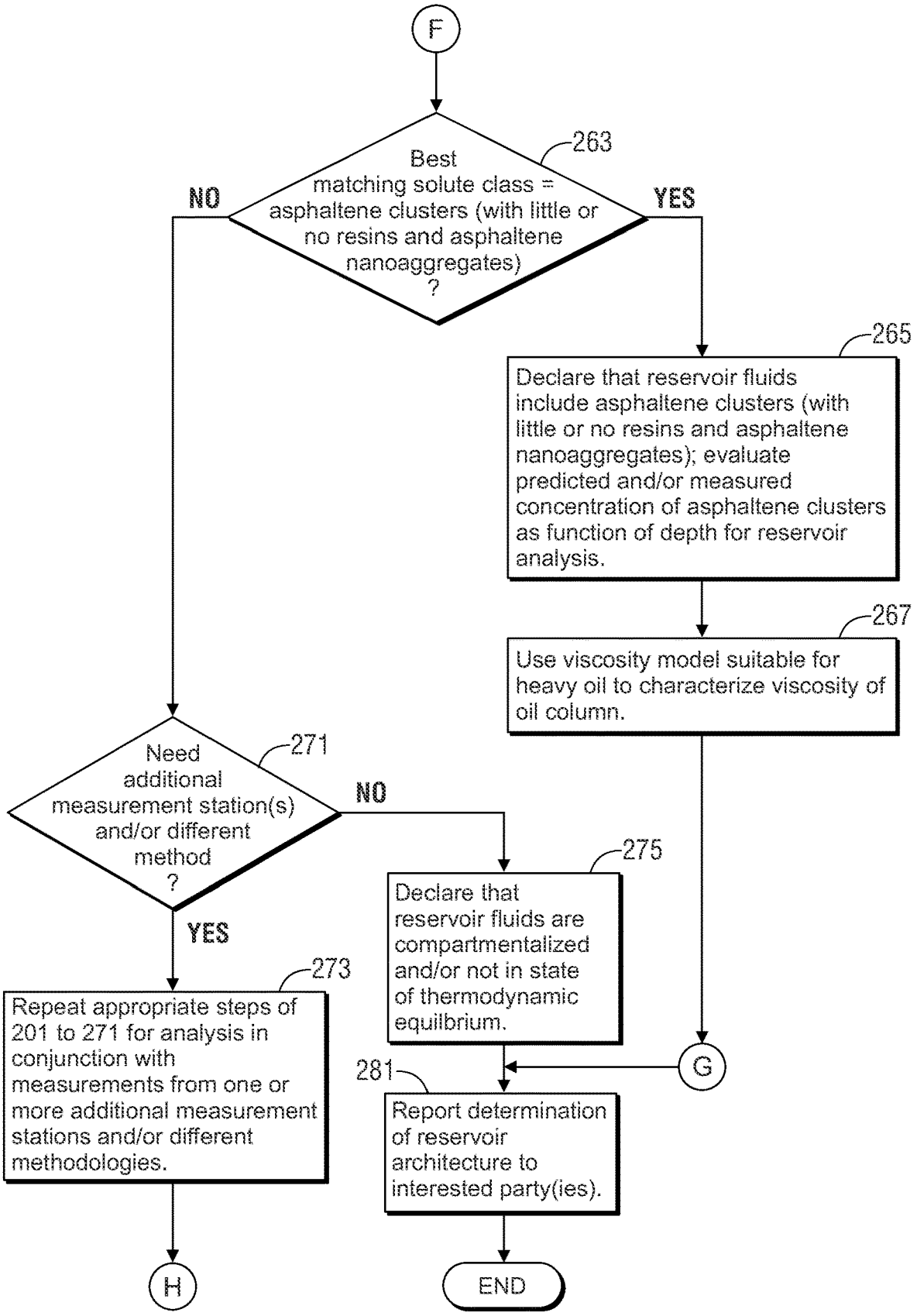

FIG. 1B illustrates an exemplary embodiment of the fluid analysis module 25 of FIG. 1A (labeled 25'), including a probe 202 having a port 204 to admit formation fluid therein. A hydraulic extending mechanism 206 may be driven by a hydraulic system 220 to extend the probe 202 to sealingly engage the formation 14. In alternative implementations, more than one probe can be used or inflatable packers can replace the probe(s) and function to establish fluid connections with the formation and sample fluid samples.

The probe 202 can be realized by the Quicksilver Probe developed by Schlumberger Technology Corporation of Sugar Land, Tex., USA. The Quicksilver Probe divides the fluid flow from the reservoir into two concentric zones, a central zone isolated from a guard zone about the perimeter of the central zone. The two zones are connected to separate flowlines with independent pumps. The pumps can be run at different rates to exploit filtrate/fluid viscosity contrast and permeability anistrotropy of the reservoir. Higher intake velocity in the guard zone directs contaminated fluid into the guard zone flowline, while clean fluid is drawn into the central zone. Fluid analyzers analyze the fluid in each flowline to determine the composition of the fluid in the respective flowlines. The pump rates can be adjusted based on such compositional analysis to achieve and maintain desired fluid contamination levels. The operation of the Quicksilver Probe efficiently separates contaminated fluid from cleaner fluid early in the fluid extraction process, which results in obtaining clean fluid in much less time compared to traditional formation testing tools.

The fluid analysis module 25' includes a flowline 207 that carries formation fluid from the port 204 through a fluid analyzer 208. The fluid analyzer 208 includes a light source that directs light to a sapphire prism disposed adjacent the flowline fluid flow. The reflection of such light is analyzed by a gas refractometer and dual fluoroscene detectors. The gas refractometer qualitatively identifies the fluid phase in the flowline. At the selected angle of incidence of the light emitted from the diode, the reflection coefficient is much larger when gas is in contact with the window than when oil or water is in contact with the window. The dual fluoroscene detectors detect free gas bubbles and retrograde liquid dropout to accurately detect single phase fluid flow in the flowline 207. Fluid type is also identified. The resulting phase information can be used to define the difference between retrograde condensates and volatile oils, which can have similar gas-oil ratios (GORs) and live-oil densities. It can also be used to monitor phase separation in real time and ensure single phase sampling. The fluid analyzer 208 also includes dual spectrometers—a filter array spectrometer and a grating-type spectrometer.

The filter array spectrometer of the analyzer 208 includes a broadband light source providing broadband light that passes along optical guides and through an optical chamber in the flowline to an array of optical density detectors that are designed to detect narrow frequency bands (commonly referred to as channels) in the visible and near-infrared spectra as described in U.S. Pat. No. 4,994,671, herein incorporated by reference in its entirety. Preferably, these channels include a subset of channels that detect water absorption peaks (which are used to characterize water content in the fluid) and a dedicated channel corresponding to the absorption peak of $CO_2$ with dual channels above and below this dedicated channel that subtract out the overlapping spectrum of hydrocarbon and small amounts of water (which are used to characterize $CO_2$ content in the fluid). The filter array spectrometer also employs optical filters that provide for identification of the color (also referred to as "optical density" or "OD") of the fluid in the flowline. Such color measurements support fluid identification, determination of asphaltene content and pH measurement. Mud filtrates or other solid materials generate noise in the channels of the filter array spectrometer. Scattering caused by these particles is independent of wavelength. In one embodiment, the effect of such scattering can be removed by subtracting a nearby channel.

The grating type spectrometer of the fluid analyzer 208 is designed to detect channels in the near-infrared spectra (preferably between 1600-1800 nm) where reservoir fluid has absorption characteristics that reflect molecular structure.

The fluid analyzer 208 also includes a pressure sensor for measuring pressure of the formation fluid in the flowline 207, a temperature sensor for measuring temperature of the formation fluid in the flowline 207, and a density sensor for measuring live fluid density of the fluid in the flowline 207. In one embodiment, the density sensor is realized by a vibrating sensor that oscillates in two perpendicular modes within the fluid. Simple physical models describe the resonance frequency and quality factor of the sensor in relation to live fluid density. Dual mode oscillation is advantageous over other resonant techniques because it minimizes the effects of pressure and temperature on the sensor through common mode rejection. In addition to density, the density sensor can also provide a measurement of live fluid viscosity from the quality factor of oscillation frequency. Note that live fluid viscosity can also be measured by placing a vibrating object in the fluid flow and measuring the increase in line width of any fundamental resonance. This increase in line width is related closely to the viscosity of the fluid. The change in frequency of the vibrating object is closely associated with the mass density of the object. If density is measured independently, then the determination of viscosity is more accurate because the effects of a density change on the mechanical resonances are determined. Generally, the response of the vibrating object is calibrated against known standards. The analyzer 208 can also measure resistivity and pH of fluid in the flowline 207. In one embodiment, the fluid analyzer 208 is realized by the Insitu Fluid Analyzer commercially available from Schlumberger Technology Corporation. In other exemplary implementations, the flowline sensors of the fluid analyzer 208 may be replaced or supplemented with other types of suitable measurement sensors (e.g., NMR sensors, capacitance sensors, etc.). Pressure sensor(s) and/or temperature sensor(s) for measuring pressure and temperature of fluid drawn into the flowline 207 can also be part of the probe 202.

A pump 228 is fluidly coupled to the flowline 207 and is controlled to draw formation fluid into the flowline 207 and possibly to supply formation fluid to the fluid collecting chambers 22 and 23 (FIG. 1A) via valve 229 and flowpath 231 (FIG. 1B).

The fluid analysis module 25' includes a data processing system 213 that receives and transmits control and data signals to the other components of the module 25' for controlling operations of the module 25'. The data processing system 213 also interfaces to the fluid analyzer 208 for receiving, storing, and processing the measurement data generated therein. In one embodiment, the data processing system 213 processes the measurement data output by the fluid analyzer 208 to derive and store measurements of the hydrocarbon composition of fluid samples analyzed insitu by the fluid analyzer 208, including flowline temperature;

flowline pressure;

live fluid density (ρ) at the flowline temperature and pressure;

live fluid viscosity (μ) at flowline temperature and pressure;

concentrations (e.g., weight percentages) of carbon dioxide ($CO_2$), methane ($CH_4$), ethane ($C_2H_6$), the C3-C5 alkane group, the lump of hexane and heavier alkane components (C6+), and asphaltene content;

GOR; and possibly other parameters (such as API gravity, oil formation volume factor ($B_0$), etc.)

Flowline temperature and pressure is measured by the temperature sensor and pressure sensor, respectively, of the fluid analyzer 208 (and/or probe 202). In one embodiment, the output of the temperature sensor(s) and pressure sensor(s) are monitored continuously before, during, and after sample acquisition to derive the temperature and pressure of the fluid in the flowline 207. The formation temperature is not likely to deviate substantially from the flowline temperature at a given measurement station and thus can be estimated as the flowline temperature at the given measurement station in many applications. Formation pressure can be measured by the pressure sensor of the fluid analyzer 208 in conjunction with the downhole fluid sampling and analysis at a particular measurement station after buildup of the flowline to formation pressure.

Live fluid density (ρ) at the flowline temperature and pressure is determined by the output of the density sensor of the fluid analyzer 208 at the time the flowline temperature and pressure are measured.

Live fluid viscosity (μ) at flowline temperature and pressure is derived from the quality factor of the density sensor measurements at the time the flowline temperature and pressure are measured.

The measurements of the hydrocarbon composition of fluid samples are derived by translation of the data output by spectrometers of the fluid analyzer 208.

The GOR is determined by measuring the quantity of methane and liquid components of crude oil using near infrared absorption peaks. The ratio of the methane peak to the oil peak on a single phase live crude oil is directly related to GOR.

The fluid analysis module 25' can also detect and/or measure other fluid properties of a given live oil sample, including retrograde dew formation, asphaltene precipitation, and/or gas evolution.

The fluid analysis module 25' also includes a tool bus 214 that communicates data signals and control signals between the data processing system 213 and the surface-located control system 18 of FIG. 1A. The tool bus 214 can also carry electric power supply signals generated by a surface-located power source for supply to the fluid analysis module 25', and the module 25' can include a power supply transformer/regulator 215 for transforming the electric power supply signals supplied via the tool bus 214 to appropriate levels suitable for use by the electrical components of the module 25'.

Although the components of FIG. 1B are shown and described above as being communicatively coupled and arranged in a particular configuration, persons of ordinary skill in the art will appreciate that the components of the fluid analysis module 25' can be communicatively coupled and/or arranged differently than depicted in FIG. 1B without departing from the scope of the present disclosure. In addition, the example methods, apparatus, and systems described herein are not limited to a particular conveyance type but, instead, may be implemented in connection with different conveyance types including, for example, coiled tubing, wireline, wired-drill-pipe, and/or other conveyance means known in the industry.

In accordance with the present disclosure, the system of FIGS. 1A and 1B can be employed with the methodology of FIGS. 2A-2G to characterize the fluid properties of a petroleum reservoir of interest based upon downhole fluid analysis of samples of reservoir fluid. As will be appreciated by those skilled in the art, the surface-located electrical control system 18 and the fluid analysis module 25 of the borehole tool 10 each include data processing functionality (e.g., one or more microprocessors, associated memory, and other hardware and/or software) that cooperate to implement the method as described herein. The electrical control system 18 can also be realized by a distributed data processing system wherein data measured by the borehole tool 10 is communicated in real time over a communication link (typically a satellite link) to a remote location for data analysis as described herein. The data analysis can be carried out on a workstation or other suitable data processing system (such as a computer cluster or computing grid).

The fluid analysis of FIGS. 2A-2G relies on a solubility model to characterize relative concentrations of high molecular weight fractions (resins and/or asphaltenes) as a function of depth in the oil column as related to relative solubility, density, and molar volume of such high molecular weight fractions (resins and/or asphaltenes) at varying depth. In one embodiment, the solubility model treats the reservoir fluid as a mixture (solution) of two parts: a solute part (resins and/or asphaltenes) and a solvent part (the lighter components other than resins and asphaltenes). The solute part is selected from a number of classes that include resins, asphaltene nanoaggregates, asphaltene clusters, and combinations thereof. For example, one class can include resins with little or no asphaltene nanoaggregates and asphaltene clusters. Another class can include asphaltene nanoaggregates with little or no resins and asphaltene clusters. A further class can include resins and asphaltene nanoaggregates with little or no asphaltene clusters. A further class can include asphaltene clusters with little or no resins and asphaltene nanoaggregates. The solvent part is a mixture whose properties are measured by downhole fluid analysis and/or estimated by the EOS model. It is assumed that the reservoir fluids are connected (i.e., there is a lack of compartmentalization) and in thermodynamic equilibrium. In this approach, the relative concentration (volume fraction) of the solute part as a function of depth is given by:

$$\frac{\phi_i(h_2)}{\phi_i(h_1)} = \exp\left\{\frac{v_i g(\rho_m - \rho_i)(h_2 - h_1)}{RT} + \left(\frac{v_i}{v_m}\right)_{h_2} - \left(\frac{v_i}{v_m}\right)_{h1} - \frac{v_i\left[(\delta_i - \delta_m)^2_{h_2} - (\delta_i - \delta_m)^2_{h_1}\right]}{RT}\right\} \quad (1)$$

where $\phi(h_1)$ is the volume fraction for the solute part at depth $h_1$, $\phi(h_2)$ is the volume fraction for the solute part at depth $h_2$, $v_i$ is the partial molar volume for the solute part, $v_m$ is the molar volume for the solution, $\delta_i$ is the solubility parameter for the solute part, $\delta_m$ is the solubility parameter for the solution, $\rho_i$ is the partial density for the solute part, $\rho_m$ is the density for the solution, R is the universal gas constant, T is the absolute temperature of the reservoir fluid, and g is the gravitational constant.

In Eq. (1) it is assumed that properties of the solute part (resins and asphaltenes) are independent of depth. For properties of the solution that are a function of depth, average values are used between the two depths, which does not result in a loss of computational accuracy. Further, if the concentrations of resins and asphaltenes are small, the properties of the solute and solvent parts (the solution) with subscript m approximate those of the solvent part. The first exponential term of Eq. (1) arises from gravitational contributions. The second and third exponential terms arise from the combinatorial entropy change of mixing. The fourth exponential term arises from the enthalpy (solubility) change of mixing. It can be assumed that the reservoir fluid is isothermal. In this case, the temperature T can be set to the average formation temperature as determined from downhole fluid analysis. Alternatively, a temperature gradient with depth (preferably a linear temperature distribution) can be derived from downhole fluid analysis and the temperature T at a particular depth determined from such temperature gradient.

The density $\rho_m$ of the solution at a given depth can be derived from the partial densities of the components of the solution at the given depth by:

$$\rho_m = \sum_j \rho_j \phi_j \tag{2}$$

where $\phi_j$ is the volume fraction of the component j of the solution at the given depth, and $\rho_j$ is the partial density for the component j of the solution at the given depth.

The volume fractions $\phi_j$ for the components of the solution at the given depth can be measured, estimated from measured mass or mole fractions, estimated from the solution of the compositional gradients produced by the EOS model, or other suitable approach. The partial density $\rho_j$ for the components of the solution at the given depth can be known, or estimated from the solution of the compositional gradients produced by the EOS model.

The molar volume $v_m$ for the solution at a given depth can be derived by:

$$v_m = \frac{\sum_j x_j m_j}{\rho_m} \tag{3}$$

where $x_j$ is the mole fraction of component j of the solution, $m_j$ is the molar mass of component j of the solution, and $\rho_m$ is the density of the solution.

The mole fractions $x_j$ of the components of the solution at the given depth can be measured, estimated from measured mass or mole fractions, estimated from the solution of the compositional gradients produced by the EOS model, or other suitable approach. The molar mass $m_j$ for the components of the solution are known. The density $\rho_m$ for the solution at the given depth is provided by the solution of Eq. (2).

The solubility parameter $\delta_m$ for the solution at a given depth can be derived as the average of the solubility parameters for the components of the solution at the given depth, given by:

$$\delta_m = \left(\sum_h \phi_j \delta_j\right) \Big/ \sum_j \phi_j \tag{4}$$

where $\phi_j$ is the volume fraction of the component j of the solution at the given depth, and $\delta_j$ is the solubility parameter for the component j of the solution at the given depth.

The volume fraction $\phi_j$ of the components of the solution at the given depth can be measured, estimated from measured mass or mole fractions, estimated from the solution of the compositional gradients produced by the EOS model, or other suitable approach. The solubility parameters $\delta_j$ of the components of the solution at the given depth can be known, or estimated from measured mass or mole fractions, estimated from the solution of the compositional gradients produced by the EOS model, or other suitable approach.

It is also contemplated that the solubility parameter $\delta_m$ for the solution at a given depth can be derived from an empirical correlation to the density $\rho_m$ of the solution at a given depth. For example, the solubility parameter $\delta_m$ (in $(MPa)^{0.5}$) can be derived from:

$$\delta_m = D\rho_m + C \tag{5}$$

where $D=(0.004878R_s+9.10199)$, $C=(8.3271\rho_m-0.004878R_s\rho_m+2.904)$, $R_s$ is the GOR at the given depth in scf/STB, and $\rho_m$ is the bulk live oil density at the given depth in $g/cm^3$.

The GOR ($R_s$) as a function of depth in the oil column can be measured by downhole fluid analysis or derived from the predictions of compositional components of the reservoir fluid as a function of depth as described below. The bulk live oil density ($\rho_m$) as a function of depth can be measured by downhole fluid analysis or derived from the predictions of compositional components of the reservoir fluid as a function of depth. In another example, the solubility parameter $\delta_m$ (in $(MPa)^{0.5}$) can be derived from a simple correlation to the density $\rho_m$ of the solution at a given depth (in $g/cm^3$) given by:

$$\delta_m = 17.347\rho_m + 2.904 \tag{6}$$

The solubility parameter $\delta_i$ of the solute part (in $MPa^{0.5}$) can be derived from a given temperature gradient relative to a reference measurement station ($\Delta T=T-T_0$) by:

$$\delta_i(T) = \delta_i(T_0)[1-1.07\times10^{-3}(\Delta T)] \tag{7}$$

where $T_o$ is the temperature at reference measurement station (e.g., $T_0$=298.15 K), and $\delta_i$ ($T_0$) is a solubility parameter $\delta_i$ of the solute part (in $MPa^{0.5}$) at $T_0$ (e.g., $\delta_i$ ($T_0$)=20.5 $MPa^{0.5}$ for the class where the solute part includes resins (with little or no asphaltene nanoaggregates or asphaltene clusters), and $\delta_i$ ($T_0$)=21.85 $MPa^{0.5}$ for those classes where the solute part includes asphaltenes (such as classes that include asphaltene nanoaggregates, asphaltene clusters, and asphaltene nanoaggregate/resin combinations).

The impact of pressure on the solubility parameter $\delta_i$ of the solute part is small and negligible.

The partial density $\rho_i$ for the solute part (in kg/m$^3$) can be derived from constants, such as 1.15 kg/m$^3$ for the class where the solute part includes resins (with little or no asphaltene nanoaggregates or asphaltene clusters), and 1.2 kg/m$^3$ for those classes where the solute part includes asphaltenes (such as classes that include asphaltene nanoaggregates, asphaltene clusters, and asphaltene nanoaggregate/resin combinations).

Other types of functions can be employed to correlate the properties of the solute part as a function of depth. For example, a linear function of the form of Eq. (8) can be used to correlate a property of the solute part (such as partial density and solubility parameter) as a function of depth $$\alpha = c\Delta h + \alpha_{ref} \tag{8}$$

where $\alpha$ is the property (such as partial density and solubility parameter) of the solute part, c is a coefficient, $\alpha_{ref}$ is the property of the solute part at a reference depth, and $\Delta h$ is the difference in height relative to the reference depth.

Once the properties noted above are obtained, the remaining adjustable parameter in Eq. (1) is the molar volume of the solute part. The molar volume of the solute part varies for the different classes. For example, resins have a smaller molar volume than asphaltene nanoaggregates, which have a smaller molar volume than asphaltene clusters. The model assumes that the molar volume of the solute part is constant as function of depth. A spherical model is preferably used to estimate the molar volume of the solute part by:

$$V = \tfrac{1}{6} * \pi * d^3 * Na \tag{9}$$

where

V is the molar volume, d is the molecular diameter, and Na is Avogadro's constant.

For example, for the class where the solute part includes resins (with little or no asphaltene nanoaggregates and asphaltene clusters), the molecular diameter d can vary over a range of 1.25±0.15 nm. For the class where the solute part includes asphaltene nanoaggregates (with little or no resins and asphaltene clusters), the molecular diameter d can vary over a range of 1.8±0.2 nm. For the class where the solute part includes asphaltene clusters (with little or no resins and asphaltene nanoaggregates), the molecular diameter d can vary over a range of 5.0±0.5 nm. For the class where the solute part is a mixture of resins and asphaltene nanoaggregates (with little or no asphaltene clusters), the molecular diameter d can vary over the range corresponding to such resins and nanoaggregates (e.g., between 1.25 nm and 1.8 nm). These diameters are exemplary in nature and can be adjusted as desired.

In this manner, Eq. (1) can be used to determine a family of curves for each solute part class. The family of curves represents an estimation of the concentration of the solute part class part as a function of height. Each curve of the respective family is derived from a molecular diameter d that falls within the range of diameters for the corresponding solute part class. A solution can be solved by fitting the curves to corresponding measurements of the concentration of the respective solute part class at varying depths as derived from downhole fluid analysis to determine the best matching curve. For example, the family of curves for the solute part class including resins (with little or no asphaltene nanoaggregates and clusters) can be fit to measurements of resin concentrations at varying depth. In another example, the family of curves for the solute part class including asphaltene nanoaggregates (with little or no resins and asphaltene clusters) can be fit to measurements of asphaltene nanoaggregate concentrations at varying depth. In still another example, the family of curves for the solute part class including asphaltene clusters (with little or no resins and asphaltene nanoaggregates) can be fit to measurements of asphaltene cluster concentrations at varying depth. In yet another example, the family of curves for the solute part class including resins and asphaltene nanoaggregates (with little or no asphaltene clusters) can be fit to measurements of mixed resins and asphaltene nanoaggregate concentrations at varying depth. If a best fit is identified, the estimated and/or measured properties of the best matching solute class (or other suitable properties) can be used for reservoir analysis. If no fit is possible, then the reservoir fluids might not be in equilibrium or a more complex formulism may be required to describe the petroleum fluid in the reservoir.

Other suitable structural models can be used to estimate and vary the molar volume for the different solute part classes. It is also possible that Eq. (1) can be simplified by ignoring the first and second exponent terms, which gives an analytical model of the form:

$$\frac{\phi_i(h_2)}{\phi_i(h_1)} = \exp\left\{\frac{v_i g(\rho_m - \rho_i)(h_2 - h_1)}{RT}\right\} \tag{10}$$

This Eq. (10) can be solved in a manner similar to that described above for Eq. (1) in order to derive the relative concentration of solute part as a function of depth (h) in the reservoir.

The operations of FIGS. 2A-2G begin in step 201 by employing the downhole fluid analysis (DFA) tool of FIGS. 1A and 1B to obtain a sample of the formation fluid at the reservoir pressure and temperature (a live oil sample) at a measurement station in the wellbore (for example, a reference station). The sample is processed by the fluid analysis module 25. In one embodiment, the fluid analysis module 25 performs spectrophotometry measurements that measure absorption spectra of the sample and translates such spectrophotometry measurements into concentrations of several alkane components and groups in the fluids of interest. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and asphaltene content. The borehole tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity and formation volume factor ($B_0$)) of the fluid sample.

In step 203, a delumping process is carried out to characterize the compositional components of the sample analyzed in 201. The delumping process splits the concentration (e.g., mass fraction, which is sometimes referred to as weight fraction) of given compositional lumps (C3-C5, C6+) into concentrations (e.g., mass fractions or weight fractions) for single carbon number (SCN) components of the given compositional lump (e.g., split C3-C5 lump into C3, C4, C5, and split C6+ lump into C6, C7, C8 . . . ). Details of the exemplary delumping operations carried out as part of step 203 are described in detail in U.S. Pat. No. 7,920,970, herein incorporated by reference in its entirety.

In step 205, the results of the delumping process of step 203 are used in conjunction with an equation of state (EOS) model to predict compositions and fluid properties (such as volumetric behavior of oil and gas mixtures) as a function of depth in the reservoir. In one embodiment, the predictions of step 205 include property gradients, pressure gradients, and temperature gradients of the reservoir fluid as a function of depth. The property gradients may include mass fractions, mole fractions, molecular weights, and specific gravities for a set of SCN components (but not for asphaltenes) as a function of depth in the reservoir. The property gradients predicted in step 205 preferably do not include compositional gradients (i.e., mass fractions, mole fractions, molecular weights, and specific gravities) for resin and asphaltenes as a function of depth as such analysis is provided by a solubility model as described herein in more detail.

The EOS model of step 205 includes a set of equations that represent the phase behavior of the compositional components of the reservoir fluid. Such equations can take many forms. For example, they can be any one of many cubic EOS as is well known. Such cubic EOS include van der Waals EOS (1873), Redlich-Kwong EOS (1949), Soave-Redlich-Kwong EOS (1972), Peng-Robinson EOS (1976), Stryjek-Vera-Peng-Robinson EOS (1986) and Patel-Teja EOS (1982). Volume shift parameters can be employed as part of the cubic EOS in order to improve liquid density predictions as is well known. Mixing rules (such as van der Waals mixing rule) can also be employed as part of the cubic EOS. A SAFT-type EOS can also be used as is well known in the art. In these equations, the deviation from the ideal gas law is largely accounted for by introducing (1) a finite (non-zero) molecular volume and (2) some molecular interaction. These parameters are then related to the critical constants of the different chemical components.

The generalized cubic EOS is expressed as:

$$P = \frac{RT}{v - b_1} - \frac{a(T_r)}{(v + b_2)(v + b_3)}\left(1 - \frac{d}{v - b_1}\right) \tag{11}$$

where P, T, $T_r$, v, R are the pressure, the temperature, the reduced temperature, the molar volume, and the universal gas constant, respectively.

The parameters a, $b_1$, $b_2$, $b_3$, and d are the cubic EOS parameters, which may be a function of temperature. For the Soave-Redlich-Kwong (SRK) EOS (1972), $b_1=b_2=b$ and $b_3=d=0$. For the Peng-Robinson (PR) EOS (1976), $b_1=(1+\sqrt{2})b$, $b_2=(1-\sqrt{2})b$, and $b_3=d=0$.

To improve liquid density predictions of a cubic EOS, the Peneloux volume shift parameter (1982) is usually employed in the two parameter cubic EOS. The cubic EOS parameters are functions of pure component physical properties such as critical pressure and temperature, acentric factor, and reduced temperature. The van der Waals mixing rule can be employed to calculate the EOS parameters of reservoir fluid mixtures as follows:

$$a = \sum_i \sum_j x_i x_j \sqrt{a_i a_j}\,(1 - k_{ij}) \tag{12A}$$

-continued $$b = \sum_i \sum_j x_i x_j \frac{b_i + b_j}{2}(1 - l_{ij}) \tag{12B}$$

where $x_i$, $a_i$ and $b_i$ are the mole fraction, parameters a and b of component i, respectively;

$x_j$, $a_j$ and $b_j$ are the mole fraction, parameters a and b of component j, respectively;

$k_{ij}$ and $l_{ij}$ are the binary interaction parameters (BIP) for parameters a and b, respectively, which are usually set equal to zero for hydrocarbon pairs, or determined by fitting the measured vapor liquid equilibrium (VLE) data of binary systems.

Therefore, the cubic EOS models require the physical properties, such as critical properties and acentric factors of pure components.

In the SAFT EOS (Gonzalez et al., 2005), residual Helmholtz energy is a sum of the terms that represent the repulsive and attractive interactions in the system:

$$a^{res} = \frac{A^{res}}{nRT} = a^{hs} + a^{disp} + a^{chain} + a^{assoc} \tag{13}$$

where

A is the Helmholtz energy;

a is the dimensionless Helmholtz energy;

n is the number of moles; and the superscripts stand for residual, hard-sphere, dispersion, chain and association, respectively.

For pure components, the SAFT EOS parameters are the energy parameter (∈), the segment diameter (σ), the range parameter (λ), and the chain-length parameter (m), which may be estimated by group contribution methods. Mixing rules and combining rules are also needed to estimate mixture parameters. Again, the SAFT EOS models require the physical properties of pure components and binary interaction parameters.

In one embodiment, the EOS model of step 205 predicts compositional gradients with depth that take into account the impacts of gravitational forces, chemical forces, thermal diffusion, etc. To calculate compositional gradients with depth in a hydrocarbon reservoir, it is usually assumed that the reservoir fluids are connected (i.e., there is a lack of compartmentalization) and in thermodynamic equilibrium (with no adsorption phenomena or any kind of chemical reactions in the reservoir). For a mixture of reservoir fluids with N-components, a set of mass flux equations for all components can be expressed as $$J_i = J_i^{Chem} + J_i^{Gr} + J_i^{Therm} + J_i^{Press} \quad i = 1, 2, \ldots N \tag{14}$$

where $J_i$ is the mass flux of component i; and the superscripts Chem, Gr, Therm and Press stand for the fluxes due to chemical, gravitational, thermal, and pressure forces, respectively.

To calculate compositional gradients with depth in a hydrocarbon reservoir using cubic EOS, it is usually assumed that all the components of reservoir fluids have zero mass flux, which is a stationary state in the absence of convection. At the stationary state, the fluxes in Eq. (14) are equal to the external flux at the boundary of the system. The external flux could be an active gas charge, $J_i^e$. For simplicity, it is assumed that the external mass flux is constant over the characteristic time scale of the filling mechanisms in the formation. By taking into account the driving forces due to chemical, gravitational, pressure, thermal impacts, and external flux, the resulting equations are given by:

$$\sum_{j=1}^{N}\left(\frac{\partial\mu_i}{\partial x_j}\right)_{T,P,n_{j\neq i}}\nabla x_j-(M_i-\bar{v}_i\rho)g+\frac{F_{Ti}}{T}\nabla T+\frac{J_i^e RT}{x_i\rho D_i}=0,\quad i=1,2,\ldots,N \tag{15}$$

where $\mu_i$, $x_i$, $v_i$, $M_i$, $D_i$, are the chemical potential, mole fraction, partial molar volume, molar mass, and effective diffusion coefficient of component i;

g, R, ρ, and T are the gravitational acceleration, universal gas constant, density, and temperature, respectively;

$x_j$ is the mole fraction of component j; and $F_{Ti}$ is the thermal diffusion flux of component i.

Since the chemical potential is a function of pressure, temperature, and mole fraction, it can be expressed under isothermal conditions as follows:

$$(\nabla\mu_i)_T=\left(\frac{\partial\mu_i}{\partial P}\right)_{T,n}\nabla P+\sum_{j=1}^{N}\left(\frac{\partial\mu_i}{\partial x_j}\right)_{T,P,n_{j\neq i}}\nabla x_j \tag{16}$$

It is also assumed that the reservoir is in hydrostatic equilibrium, i.e.:

$$\nabla P=\rho g \tag{17}$$

According to the thermodynamic relations, the partial molar volume is defined as:

$$\bar{v}_i=\left(\frac{\partial\mu_i}{\partial P}\right)_{T,n} \tag{18}$$

Therefore, the chemical potential change at constant temperature is rewritten as $$(\nabla\mu_i)_T=\bar{v}_i\rho g+\sum_{j=1}^{N}\left(\frac{\partial\mu_i}{\partial x_j}\right)_{T,P,n_{j\neq i}}\nabla x_j \tag{19}$$

Substituting Eq. (18) into Eq. (15), the following equation is obtained:

$$(\nabla\mu_i)_T-M_i g+\frac{F_{Ti}}{T}\nabla T+\frac{J_i^e RT}{x_i\rho D_i}=0\quad i=1,2,\ldots,N \tag{20}$$

The thermal diffusion flux of component i ($F_{Ti}$) can be calculated by the different thermal diffusion models. An example is the Haase expression:

$$F_{Ti}=M_i\left(\frac{H_m}{M_m}-\frac{H_i}{M_i}\right) \tag{21}$$

where subscripts m and i stand for the property of the mixture and component i, respectively; and H is the molar enthalpy.

The chemical potential is calculated through the calculation of fugacity. The resulting equation is given by:

$$\Delta(\ln f_i)-\frac{M_i g\Delta h}{RT}+M_i\left(\frac{H_m}{M_m}-\frac{H_i}{M_i}\right)\frac{\Delta T}{RT^2}+\frac{J_i^e\Delta h}{x_i\rho D_i}=0,\quad i=1,2,\ldots,N \tag{22}$$

where $f_i$ is the fugacity of component i and h stands for the vertical depth.

A cubic EOS such as the Peng-Robinson (PR) EOS can be used to estimate the fugacity of component i. Therefore, Eq. (22) is rearranged as:

$$\ln(\varphi_i x_i P)|_h-\ln(\varphi_i x_i P)|_{h_0}=\frac{M_i g(h-h_0)}{RT}-M_i\left(\frac{H_m}{M_m}-\frac{H_i}{M_i}\right)\frac{(T-T_0)}{RT^2}-\frac{J_i^e(h-h_0)}{x_i\rho D_i},\quad i=1,2,\ldots,N \tag{23}$$

where $\varphi_i$ and $x_i$ are the fugacity coefficient and mole fraction of component i, respectively, and $h_0$ denotes the reference depth.

As shown in Eq. (23), the Peneloux et al. volume shift impacts compositional gradient calculations because the volume shift term in the fugacity coefficient of component i is expressed as $$\ln\varphi_i^{Peneloux_PR_EOS}=\ln\varphi_i^{Original_PR_EOS}-\frac{c_i P}{RT} \tag{24}$$

where the superscripts, Peneloux_PR_EOS and Original_PR_EOS stand for the fugacity coefficients calculated by the PR EOS with and without the Peneloux volume shift, respectively; and $c_i$ is the volume shift parameter of component i.

Because P at h and $h_0$ are different, the volume shift terms cannot be cancelled out in Eq. (23).

The mole fractions of the components at a given depth must further sum to 1 such that $$\sum_{i=1}^{N}x_i=1$$

at a given depth. Provided the mole fractions and the reservoir pressure and temperature are known at the reference station, these equations can be solved for mole fractions (and mass fractions), partial molar volumes, and volume fractions for the reservoir fluid components, as well as pressure and temperature as a function of depth. Flash calculations can solve for fugacities of components of the reservoir fluid that form at equilibrium. Details of suitable flash calculations are described by Li in "Rapid Flash Calculations for Compositional Simulation," *SPE Reservoir Evaluation and Engineering*, October 2006, herein incorporated by reference in its entirety. The flash equations are based on a fluid phase equilibrium model that finds the number of phases and the distribution of species among the phases, that minimizes Gibbs Free Energy. More specifically, the flash calculations calculate the equilibrium phase conditions of a mixture as a function of pressure, temperature, and composition.

In step 205, the predictions of compositional gradient can be used to predict properties of the reservoir fluid as a function of depth (typically referred to as a property gradient) as is well known. For example, the predictions of compositional gradient can be used to predict bulk fluid properties (such as molar volume, molecular weight, live fluid density, stock tank density, bubble point pressure, dew point pressure, gas-oil ratio, live fluid density) as well as other pressure-volume-temperature (PVT) properties of the reservoir fluid as a function of depth in the reservoir. The EOS of step 205 preferably calculates the predictions of compositional gradient without taking into account resins and asphaltenes separately and specially as such predictions are provided by a solubility model as described herein in more detail.

In step 207, the DFA borehole tool 10 of FIGS. 1A and 1B is used to obtain a sample of the formation fluid at the reservoir pressure and temperature (a live oil sample) at another measurement station in the wellbore, and the downhole fluid analysis as described above with respect to step 201 is performed on this sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and asphaltene content. The borehole tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity, formation volume factor ($B_0$), etc.) of the fluid sample.

Optionally, in step 209 the EOS model of step 205 can be tuned based on a comparison of the compositional and fluid property predictions derived by the EOS model of step 205 and the compositional and fluid property analysis of the DFA borehole tool 10 in step 207. Laboratory data can also be used to tune the EOS model. Such tuning typically involves selecting parameters of the EOS model in order to improve the accuracy of the predictions generated by the EOS model. EOS model parameters that can be tuned include critical pressure, critical temperature, and acentric factor for single carbon components, binary interaction coefficients, and volume translation parameters. An example of EOS model tuning is described in Almehaideb et al., "EOS tuning to model full field crude oil properties using multiple well fluid PVT analysis," *Journal of Petroleum Science and Engineering*, Volume 26, Issues 1-4, pp. 291-300, 2000, herein incorporated by reference in its entirety. In the event that the EOS model is tuned, the compositional and fluid property predictions of step 205 can be recalculated from the tuned EOS model.

In step 211, the predictions of compositional gradients generated in step 205 (or in step 209 in the event that the EOS is tuned) are used to derive solubility parameters of the solvent part (and possibly other property gradients or solubility model inputs) as a function of depth in the oil column. For example, the predictions of compositional gradients can be used to derive the density of the solvent part (Eq. (2)), the molar volume of the solvent part (Eq. (3)), and the solubility parameter of the solvent part (Eq. (4) or (5)) as a function of depth.

In steps 213 to 219, the solute part is treated as a particular first-type class, for example a class where the solute part includes resins (with little or no asphaltene nanoaggregates and asphaltene clusters). This class generally corresponds to reservoir fluids that include condensates with very small concentrations of asphaltenes. Essentially, the high content of dissolved gas and light hydrocarbons creates a poor solvent for asphaltenes. Moreover, the processes that generate condensates do not tend to generate asphaltenes. For this class, the operations rely on an estimate that the average spherical diameter of resins is 1.25±0.15 nm and that resins impart color at a predetermined visible wavelength (647 nm). The average spherical diameter of 1.25±0.15 nm corresponds to an average molecular weight of 740±250 g/mol. Laboratory centrifuge data also has shown the spherical diameter of resins is ~1.3 nm. This is consistent with the results in the literature. It is believed that resins impart color in the shorter visible wavelength range due to their relatively small number of fused aromatic rings ("FARs") in polycyclic aromatic hydrocarbons ("PAHs"). In contrast, asphaltenes impart color in both the short visible wavelength range and the longer near-infrared wavelength range due to their relatively larger number of FARs in PAHs. Consequently, resins and asphaltenes impart color in the same visible wavelength range due to overlapping electronic transitions of the numerous PAHs in the oil. However, in the longer near-infrared wavelength range, the optical absorption is predominantly due to asphaltenes.

In step 215, a number of average spherical diameter values within the range of 1.25±0.15 nm (e.g., d=1.1 nm, d=1.2 nm, d=1.3 nm and d=1.4 nm) are used to estimate corresponding molar volumes for the particular solute part class utilizing Eq. (9).

In step 217, the molar volumes estimated in step 215 are used in conjunction with the Flory-Huggins type solubility model described above with respect to Eq. (1) to generate a family of curves that predict the concentration of the particular solute part class of step 213 as a function of depth in the reservoir.

In step 219, the family of curves generated in step 217 is compared to measurement of resin concentration at corresponding depths as derived from associated DFA color measurements at the predetermined visible wavelength (647 nm). The comparisons are evaluated to identify the diameter that best satisfies a predetermined matching criterion. In one embodiment, the matching criterion determines that there are small differences between the resin concentrations as a function of depth as predicted by the Flory-Huggins type solubility model and the corresponding resin concentrations measured from DFA analysis, thus providing an indication of a proper match within an acceptable tolerance level.

In steps 221 to 227, the solute part is treated as a particular second-type class, for example a class where the solute part includes asphaltene nanoaggregates (with little or no resins and asphaltene clusters). This class generally corresponds to low GOR black oils that usually have little compressibility. These types of black oils often contain asphaltene molecules with 4 to 7 FARs in PAHs. The asphaltene molecules are dispersed in the oil as nanoaggregates with an aggregation number of 2-8. For this class, the operations rely on an estimate that the average spherical diameter of asphaltene nanoaggregates is 1.8±0.2 nm and that the asphaltene nanoaggregates impart color at a predetermined near infrared (NIR) wavelength (1070 nm). The average spherical diameter of 1.8±0.2 nm corresponds to an average molecular weight of 2200±700 g/mol. This is consistent with the results in the literature. Field and laboratory analysis have shown that asphaltene nanoaggregates impart color in both the visible wavelength range around 640 nm and the near wavelength range around 1070 nm. It is believed that the asphaltene nanoaggregates impart color in both the short visible wavelength range and the longer NIR wavelength range due to their relatively larger number of FARs in PAHs.

In step 223, a number of average spherical diameter values within the range of 1.8±0.2 nm (e.g., d=1.6 nm, d=1.7 nm, d=1.8 nm, d=1.9 nm, and d=2.0 nm) are used to estimate corresponding molar volumes for the particular solute part class utilizing Eq. (9).

In step 225, the molar volumes estimated in step 223 are used in conjunction with the Flory-Huggins type solubility model described above with respect to Eqn. (1) to generate a family of curves that predict the concentration of the particular solute part class of step 221 as a function of depth in the reservoir.

In step 227, the family of curves generated in step 225 is compared to measurement of asphaltene nanoaggregate concentration at corresponding depths as derived from associated DFA color measurements at the predetermined NIR wavelength (1070 nm). The comparisons are evaluated to identify the diameter that best satisfies a predetermined matching criterion. In one embodiment, the matching criterion determines that there are small differences between the asphaltene nanoaggregate concentrations as a function of depth as predicted by the Flory-Huggins type model and the corresponding asphaltene nanoaggregate concentrations measured from DFA analysis, thus providing an indication of a proper match within an acceptable tolerance level.

In steps 229 to 235, the solute part is treated as a particular third-type class, for example a class where the solute part includes a combination of resins and asphaltene nanoaggregates (with little or no asphaltene clusters). This class generally corresponds to black oils that include a mixture of resins and asphaltene nanoaggregates. For this class, the operations rely on an estimate that the average spherical diameter of the mixed resins and asphaltene nanoaggregates varies linearly from 1.5±0.2 nm to 2.0±0.2 nm according to wavelength in a range between a visible wavelength (647 nm) and a NIR wavelength (1070 nm). This conforms to an assumption that the average molecular diameter for mixed resin and asphaltene nanoaggregates increases linearly with increasing wavelength due to the increasing importance of absorption from the asphaltene aggregates in the longer wavelength region. It is believed that the asphaltene nanoaggregate content (weight %) contributing to color increases exponentially with increasing wavelength. In the preferred embodiment, the relationship between the average spherical diameter (d) and wavelength can be given by:

$$d = C1 * \text{Wavelength} + C2 \tag{25}$$

where C1 and C2 are two constants.

C1 and C2 can be determined by solving the relation utilizing two diameter/wavelength combinations. For instance, a combination of d=1.5 nm at 647 nm and a combination of d=2.0 nm at 1070 nm can be used to solve for C1 and C2. In another example, a combination of d=1.3 nm at 647 nm and a combination of d=1.8 nm at 1070 nm can be used to solve for C1 and C2. In yet another example, a combination of d=1.7 nm at 647 nm and a combination of d=2.2 nm at 1070 nm can be used to solve for C1 and C2.

In step 231, a number of average spherical diameter values and wavelength combinations defined by the relationship of step 229 are used to estimate corresponding molar volumes for the particular solute part class utilizing Eq. (9).

In step 233, the molar volumes estimated in step 231 are used in conjunction with the Flory-Huggins type solubility model described above with respect to Eq. (1) to generate a family of curves that predict the concentration of the particular solute part class of step 229 as a function of depth in the reservoir. Each curve is associated with a particular average spherical diameter value and wavelength combination.

In step 235, the family of curves generated in step 233 are compared to measurement of mixed resins and asphaltene nanoaggregate concentrations at corresponding depths as derived from associated DFA color measurements at the wavelength of the given diameter/wavelength combination for the respective curve. The comparisons are evaluated to identify the diameter that best satisfies a predetermined matching criterion. In one embodiment, the matching criterion determines that there are small differences between the mixed resin and asphaltene nanoaggregate concentrations as a function of depth as predicted by the Flory-Huggins type solubility model and the corresponding mixed resin and asphaltene nanoaggregate concentrations measured from DFA analysis, thus providing an indication of a proper match within an acceptable tolerance level.

In steps 237 to 243, the solute part is treated as a particular fourth-type class, for example a class where the solute part includes asphaltene clusters. This class generally corresponds to black oils where the asphaltene gradient is very large in the oil column. This behavior implies that both asphaltene nanoaggregates and asphaltene clusters are suspended in the oil column. For this class, the operations rely on an estimate that the average spherical diameter of asphaltene clusters is 4.5±0.5 nm at a predetermined NIR wavelength (1070 nm). Field and laboratory analysis have shown that asphaltene clusters impart color in both the visible wavelength range around 640 nm and the NIR wavelength range around 1070 nm. It is believed that the asphaltene clusters impart color in both the short visible wavelength range and the longer NIR wavelength range due to their relatively larger number of FARs in PAHs.

In step 239, a number of average spherical diameter values within the range of 4.5±0.5 nm (e.g., d=4.0 nm, d=4.3 nm, d=4.5 nm, d=4.8 nm, and d=5.0 nm) are used to estimate corresponding molar volumes for the particular solute part class utilizing Eq. (9).

In step 241, the molar volumes estimated in step 239 are used in conjunction with the Flory-Huggins type solubility model described above with respect to Eq. (1) to generate a family of curves that predict the concentration of the particular solute part class of step 237 as a function of depth in the reservoir.

In step 243, the family of curves generated in step 241 is compared to measurement of asphaltene cluster concentration at corresponding depths as derived from associated DFA color measurements at the predetermined NIR wavelength (1070 nm). The comparisons are evaluated to identify the diameter that best satisfies a predetermined matching criterion. In one embodiment, the matching criterion determines that there are small differences between the asphaltene cluster concentrations as a function of depth as predicted by the Flory-Huggins type model and the corresponding asphaltene cluster concentrations measured from DFA analysis, thus providing an indication of a proper match within an acceptable tolerance level.

In step 245, the matching diameters identified in steps 219, 227, 235, and 243 (if any) are evaluated to determine the best matching diameter of the group. The evaluation provides an indication of which particular solute part class (and thus the assumption of composition underlying the particular solute part class) is the best match to the measured gradient for the solvent part high molecular weight fractions.

In step 247, a curve belonging to the curves generated in steps 217, 225, 233, and 241 is selected that corresponds to the particular solute part class and best matching diameter identified in step 245.

In step 249, the curve selected in step 247 is used to predict the concentration of the best matching solute part class as a function of depth in the reservoir.

In step 251, the best matching solute part class identified in step 245 is evaluated to determine if it corresponds to the first-type solute part class of steps 213 to 219 where the solute part includes resins (with little or no asphaltene nanoaggregates and asphaltene clusters). If this condition is true, the operations continue to step 253. Otherwise the operations continue to step 255.

In step 253, the workflow declares that that the reservoir fluids are in thermal equilibrium within a non-compartmentalized reservoir, and the reservoir fluids include resins (with little or no asphaltene nanoaggregates and asphaltene clusters) in accordance with assumptions underlying the first-type solute part class of steps 213 to 219. In this case, the reservoir fluid includes condensates with a very small concentration of asphaltenes. Essentially, the high content of dissolved gas and light hydrocarbons create a very poor solvent for asphaltenes. Moreover, processes that generate condensates do not tend to generate asphaltenes. Consequently, there is very little crude oil color as determined by DFA in the near infrared. Nevertheless, there are asphaltene-like molecules—the resins—that absorb visible light and at times even some near infrared light. These resin molecules are largely dispersed in the condensate as molecules—thereby reducing the impact of the gravitational term. In addition, condensates exhibit considerable gradients. Since condensates are compressible, therefore, the hydrostatic head pressure of the condensate column generates a density gradient in the column. The density gradient creates the driving force to create a chemical composition gradient. The lower density components tend to rise in the column while the higher density components tend to settle down in the column. This GOR gradient gives rise to a large solubility contrast for the resins thereby producing significant DFA color gradients. These gradients are useful to check for reservoir connectivity. Accordingly, the GOR gradient as determined by DFA analysis can be evaluated for reservoir analysis as part of step 261. The predicted and/or measured concentration of the resin component as a function of depth can also be evaluated for reservoir analysis as part of step 261. More specifically, the declaration of connectivity (non-compartmentalization) can be indicated by moderately decreasing GOR values with depth, a continuous increase of resin content as a function of depth, and/or a continuous increase of fluid density and/or fluid viscosity as a function of depth. On the other hand, compartmentalization and/or non-equilibrium can be indicated by discontinuous GOR (or if lower GOR is found higher in the column), discontinuous resin content (or if higher asphaltene content is found higher in the column), and/or discontinuous fluid density and/or fluid viscosity (or if higher fluid density and/or fluid viscosity is found higher in the column). The operations then continue to step 281.

In step 255, the best matching solute part class identified in step 245 is evaluated to determine if it corresponds to the second-type solute part class of steps 221 to 227 where the solute part includes asphaltene nanoaggregates (with little or no resins and asphaltene clusters). If this condition is true, the operations continue to step 257. Otherwise the operations continue to step 259.

In step 257, the workflow declares that the reservoir fluids are in thermal equilibrium within a non-compartmentalized reservoir, and the reservoir fluids include asphaltene nanoaggregates (with little or no resins and asphaltene clusters) in accordance with assumptions underlying the second-type solute part class of steps 221 to 227 where the solute part includes asphaltene nanoaggregates (with little or no resins and asphaltene clusters). In this case, the predicted and/or measured concentration of the asphaltene nanoaggregates as a function of depth can be evaluated for reservoir analysis as part of step 257. More specifically, the declaration of connectivity (non-compartmentalization) can be indicated by a continuous increase of asphaltene nanoaggregate content as a function of depth, and/or a continuous increase of fluid density and/or fluid viscosity as a function of depth. On the other hand, compartmentalization and/or non-equilibrium can be indicated by discontinuous asphaltene nanoaggregate content (or if higher asphaltene nanoaggregate content is found higher in the column), and/or discontinuous fluid density and/or fluid viscosity (or if higher fluid density and/or fluid viscosity is found higher in the column). The operations then continue to step 281.

In step 259, the best matching solute part class identified in step 245 is evaluated to determine if it corresponds to the third-type solute part class of steps 229 to 235 where the solute part includes a mix of resins and asphaltene nanoaggregates (with little or no asphaltene clusters). If this condition is true, the operations continue to step 261. Otherwise the operations continue to step 263.

In step 261, the workflow declares that that the reservoir fluids are in thermal equilibrium within a non-compartmentalized reservoir, and the reservoir fluids include a mix of resins and asphaltene nanoaggregates (with little or no asphaltene clusters) in accordance with assumptions underlying the third-type solute part class of steps 229 to 235 where the solute part includes a mix of resins and asphaltene nanoaggregates (with little or no asphaltene clusters). In this case, the predicted and/or measured concentration of the mixture of resins and asphaltene nanoaggregates as a function of depth can be evaluated for reservoir analysis as part of step 261. More specifically, the declaration of connectivity (non-compartmentalization) can be indicated by a continuous increase of the concentration of the resin/asphaltene nanoaggregate mixture as a function of depth, and/or a continuous increase of fluid density and/or fluid viscosity as a function of depth. On the other hand, compartmentalization and/or non-equilibrium can be indicated by discontinuous concentration of the resin/asphaltene nanoaggregate mixture (or if a higher concentration of the resin/asphaltene nanoaggregate mixture is found higher in the column), and/or discontinuous fluid density and/or fluid viscosity (or if higher fluid density and/or fluid viscosity is found higher in the column). The operations then continue to step 281.

In step 263, the best matching solute part class identified in step 245 is evaluated to determine if it corresponds to the fourth-type solute part class of steps 237 to 243 where the solute part includes asphaltene clusters. If this condition is true, the operations continue to steps 265 and 267. Otherwise the operations continue to step 271.

In step 265, the workflow declares that the reservoir fluids include asphaltene clusters in accordance with assumptions underlying the fourth-type solute part class of steps 237 to 243 where the solute part includes asphaltene clusters. In this case, the predicted and/or measured concentration of the asphaltene clusters as a function of depth can be evaluated for reservoir analysis as part of step 265. More specifically, the declaration of connectivity (non-compartmentalization) can be indicated by a continuous increase of asphaltene cluster content as a function of depth, and/or a continuous increase of fluid density and/or fluid viscosity as a function of depth. On the other hand, compartmentalization and/or non-equilibrium can be indicated by discontinuous asphaltene cluster content (or if higher asphaltene cluster content is found higher in the column), and/or discontinuous fluid density and/or fluid viscosity (or if higher fluid density and/or fluid viscosity is found higher in the column).

Note that in step 265, heavy oil or bitumen is expected in the oil column due to the presence of asphaltene clusters. Moreover, because asphaltene clusters are expected in the oil column, it is anticipated that large density and viscosity gradients exist in the oil column, and a large API gravity increase exists in the oil column.

In step 267, a viscosity model suitable for heavy oil with large viscosity gradients is used to characterize the viscosity of the oil column. In the preferred embodiment, the viscosity model of step 267 is a state principle model of viscosity, which models viscosity of a mixture (live heavy oil) based upon corresponding states theory to predict viscosity of the mixture as a function of temperature, pressure, composition of the mixture, pseudo-critical properties of the mixture, and the viscosity of a reference substance evaluated at a reference pressure and temperature. In one example, the state principle model of viscosity is based on the Pedersen et al. model (1984), which has the form:

$$\mu_m(P, T) = \left(\frac{T_{cm}}{T_{co}}\right)^{-\frac{1}{6}}\left(\frac{P_{cm}}{P_{co}}\right)^{\frac{2}{3}}\left(\frac{MW_m}{MW_o}\right)^{\frac{1}{2}}\left(\frac{\alpha_m}{\alpha_o}\right)\mu_0(P_o, T_o) \tag{26}$$

where $T_{cm}$ is the critical temperature of the mixture (live heavy oil);

$T_{co}$ is the critical temperature of the reference fluid;

$P_{cm}$ is the critical pressure of the mixture;

$P_{co}$ is the critical pressure of the reference fluid;

$MW_m$ is the molecular weight of the mixture; and $MW_o$ is the molecular weight of the reference fluid.

The parameters $\alpha_m$ for the mixture and $\alpha_o$ for the reference fluid are given by:

$$\alpha_m = 1.000 + 7.378*10^{-3}\rho_{ro}^{1.847}MW_m^{0.5173} \tag{27A}$$

$$\alpha_0 = 1.000 + 0.31\rho_{ro}^{1.847} \tag{27B}$$

The parameter $\rho_{ro}$ is the reduced density of the reference fluid evaluated at a reference pressure and temperature as indicated in the following:

$$\rho_{ro} = \frac{\rho_0}{\rho_{co}} \tag{28}$$

where $\rho_o$ is the density of the reference fluid at the reference temperature and pressure;

and $\rho_{co}$ is the critical density of the reference fluid.

The parameter $\mu_0$ is the viscosity of the reference fluid evaluated at a pressure $P_o$ and temperature $T_o$.

The parameters $P_{co}$, $T_{co}$, $\rho_{co}$ and $MW_o$ of the reference fluid can be derived from empirical data. $MW_m$ is the molecular weight of the mixture and initially set to an arbitrary value in a predetermined range (preferably, in the range between 1500-3000 g/mol). Note that this arbitrary value is much less than the real molar mass of asphaltene clusters, which is about 60,000 g/mol. This adaptation is required because the corresponding state viscosity model is not developed for heavy oil of molar mass up to 60,000 g/mol. $P_{cm}$ of the mixture is given by correlation to other fluid properties, preferably by a correlation to $MW_m$. For example, $P_{cm}$ in atm can be derived as:

$$P_{cm} = 53.6746MW_m^{-0.2749} \tag{29}$$

The density $\rho_o$ and the viscosity $\mu_0$ for the reference fluid can be related to T and P utilizing well known statistical techniques.

Eq. (26) can be used to solve (tune) the critical temperature $T_{cm}$ for a reference depth where the temperature T and the pressure P and the viscosity $\mu_m$ of the reservoir fluid (live heavy oil) are known by DFA or laboratory analysis. Such tuning can be accomplished by initializing the critical temperature $T_{cm}$, calculating viscosity with the viscosity model of Eq. (26), comparing the difference between the calculated viscosity to the corresponding measured viscosity $\mu_m$ of the reservoir fluid, and updating the critical temperature $T_{cm}$ if the difference is greater than a predetermined error tolerance threshold. If the difference is less than (or equal to) the predetermined error tolerance threshold, then the tuning is finished. After tuning the critical temperature $T_{cm}$, the tuned critical temperature $T_{cm}$ together with the parameters $P_{co}$, $T_{co}$, $MW_o$, $P_{cm}$, and $MW_m$ with the viscosity model of Eq. (26) are used to characterize the viscosity $\mu_m$ of the mixture (live heavy oil) as a function of depth in the reservoir. Specifically, the temperature T and the pressure P for the given depth are used to derive the density $\rho_o$ and the viscosity $\mu_0$ for the reference fluid at a given depth. The density $\rho_o$ is used solve for the reduced density $\rho_{ro}$ of the reference fluid at the given depth according to Eq. (28). The reduced density Pro is used to solve for $\alpha_m$ and $\alpha_o$ according to Eqs. (27A) and (27B). Finally, the parameters $P_{co}$, $T_{co}$, $MW_o$, $P_{cm}$, the tuned $T_{cm}$, $MW_m$, $\alpha_m$, $\alpha_o$ and the viscosity $\mu_0$ are used to solve for the viscosity $\mu_m$ at the given depth according to Eq. (26).

Note that other parameters of the viscosity model of Eq. (26), such as the critical pressure $P_{cm}$, can be treated as an adjustable parameter and tuned as described above. Such tuning can involve a number of adjustable parameters, if desired.

Other simple viscosity models suitable for heavy oil can be used to characterize the viscosity of the oil column.

For example, a viscosity model developed by Pal and Rhodes can be used to characterize viscosity of the oil column in step 267. The Pal and Rhodes viscosity model is described in Pal, R., and Rhodes, E., "Viscosity/concentration relationships for emulsions," *Journal of Rheology*, Vol. 33, 1989, pp. 1021-1045. The Pal-Rhodes viscosity model takes into account the solvation impact of a concentrated emulsion. In the Pal-Rhodes viscosity model, the emulsion droplets are assumed to be spherical. Lin et al. "Asphaltenes: fundamentals and applications: The effects of asphaltenes on the chemical and physical characteristics of asphalt." Shu, E. Y., and Mullins, O. C., editors, New York, Plenum Press, 1995, pp. 155-176, modified the Pal-Rhodes viscosity model to account for non-spherical dispersed solid particles in a suspension as follows:

$$\frac{\eta}{\eta_M} = [1 - K \cdot \phi]^{-\nu} \tag{30}$$

where $\eta$ and $\eta_M$ are the viscosity of a colloidal solution and the continuous phase (solvent), respectively;

K is the solvation constant;

$\phi$ is the volume fraction of the dispersed phase (i.e., asphaltenes); and $\nu$ is the shape factor ($\nu$=2.5 for rigid spherical particles in the original Pal-Rhodes model, and $\nu$=6.9 for heavy oil as set forth in Lin et al.).

The asphaltene (cluster) volume fraction $\phi$ can be expressed as a function of asphaltene (cluster) weight fraction at a given depth as follows:

$$\phi = \frac{\rho}{\rho_a} A, \tag{31}$$

where $\rho$ and $\rho_a$ are the densities of oil mixtures and asphaltenes (clusters), respectively, at the given depth, and A is the weight fraction of asphaltenes (clusters) at the given depth.

Substituting Eq. (31) into Eq. (30) gives:

$$\frac{\eta}{\eta_M} = [1 - K' \cdot A]^{-\nu}, \tag{32}$$

where K' is a solvation constant (different from K) represented by $$\frac{\rho}{\rho_a} K.$$

If viscosity at a reference location ($\eta_0$ is known, the Pal-Rhodes viscosity model can be used to calculate the viscosity $\eta$ of the heavy oil at stock tank conditions as follows:

$$\frac{\eta}{\eta_0} = \left[\frac{1 - K' \cdot A}{1 - K' \cdot A_0}\right]^{-\nu}, \tag{33}$$

where the subscript 0 denotes the properties at the reference location. The weight fraction of asphaltenes A and $A_0$ can be derived from the optical density versus asphaltene correlations, or other suitable approach. K' is calculated from the expression $$K' = \frac{\rho}{\rho_a} K,$$

where the density $\rho$ can be measured by DFA or derived from the following:

$$\frac{1}{\rho} = \frac{A}{\rho_a} + \frac{(1 - A)}{\rho_M}, \tag{34}$$

where $\rho_a$ is the density of asphaltene (=1.2 g/cc), and $\rho_M$ is the density of the continuous phase, which is the maltene (i.e., the components of the oil mixture less asphaltene).

The maltene density $\rho_M$ can be treated as an adjustable parameter and derived from EOS.

In another example, a viscosity model developed by Mooney can be used to characterize viscosity of the oil column in step 267. The Mooney viscosity model for heavy oil is described in Mooney, "The viscosity of a concentrated suspension of spherical particles," *Journal Colloid Science*, Vol. 6, 1951, pp. 162-170 as follows:

$$\frac{\eta}{\eta_M} = \exp\left[\frac{[\eta]\phi}{1 - \frac{\phi}{\phi_{max}}}\right], \tag{35}$$

where $\eta$ and $\eta_M$ are the viscosity of a colloidal solution and the continuous phase (solvent), respectively;

$[\eta]$ is the intrinsic viscosity;

$\phi$ is the volume fraction of the dispersed phase; and $\phi_{max}$ is the packing volume fraction.

The Mooney viscosity model can be modified for heavy oil as follows:

$$\frac{\eta}{\eta_M} = \exp\left[\frac{[\eta]A}{1 - \frac{A}{A_{max}}}\right] \tag{36}$$

where A is the weight fraction of asphaltenes; and $A_{max}$ is a parameter, which can be set to 0.7.

If the viscosity at a reference location ($\eta_0$) is known, the Mooney viscosity model can be used to calculate the viscosity $\eta$ of the heavy oil at stock tank conditions as follows:

$$\frac{\eta}{\eta_0} = \exp\left[[\eta]\left(\frac{A}{1 - \frac{A}{A_{max}}} - \frac{A_0}{1 - \frac{A_0}{A_{max}}}\right)\right]. \tag{37}$$

The subscript 0 denotes the properties at the reference location. The weight fraction of asphaltenes A and $A_0$ can be derived from the optical density versus asphaltene correlations, or other suitable approach. The intrinsic viscosity $[\eta]$ can be treated as an adjustable parameter and derived from viscosity data at least two DFA stations.

The viscosity models as described above can be extended to account for the effect of GOR, pressure and temperature on viscosity. One such extension is described in Hildebrand, J. H., and Scott, R. L., "The Solubility of Nonelectrolytes," 3rd ed., Reinhold, New York, (1950) as follows:

$$\left(\frac{\eta}{\eta_0}\right)_{live} = \left(\frac{\eta}{\eta_0}\right)_{STO}\left[\left(\frac{GOR_{s0}}{GOR_s}\right)^{1/3}\right]\left(\frac{T_0}{T}\right)^{4.5} \exp[9.6 \times 10^{-5}(P - P_0)], \tag{37}$$

where $$\left(\frac{\eta}{\eta_0}\right)_{STO}$$

is derived for stock tank conditions as described above, the pressures P and $P_0$ are calculated in psia, the temperatures T and $T_0$ are calculated in Rankine (R), and the gas-oil-ratios $GOR_s$ and $GOR_{s0}$ are calculated for the solution in scf/bbl.

The subscript 0 denotes the properties at the reference location. These corrections are similar to expressions given by Khan et al. in "Viscosity Correlations for Saudi Arabian Crude Oils," SPE Paper 15720, Fifth SPE Middle East Conference, Bahrain, Mar. 7-10, 1987 which determined that the viscosity of undersaturated oil is inversely proportional to $GOR_s^{1/3}$ and $T^{4.5}$.

In the case that the density calculation of Eq. (34) is used to derive $$\left(\frac{\eta}{\eta_0}\right)_{STO}$$

for the live heavy oil viscosity calculations of Eq. (33), the effects of GOR, pressure, and temperature on the density calculations of Eq. (34) can be taken into account by:

$$\frac{\rho}{\rho_0} = \left(\frac{GOR_{s0}}{GOR_s}\right)^{\alpha} \exp[-\beta(T - T_0)]\exp[c_o(P - P_0)] \tag{38}$$

where $\alpha$ is a parameter, which can be set to a value such as 0.05;

$\beta$ is the isobaric thermal expansion coefficient of the fluid, which can be set to a value such as $5\times10^{-4}$ 1/K; and $c_o$ denotes compressibility, which can be set to a value such as $9\times10^{-6}$ 1/psia).

Note that the viscosity model of step 267 can be tuned to match viscosity of the reservoir fluids measured by downhole fluids analysis (steps 201 and 207) or laboratory analysis, if desired. Such viscosity model tuning is typically accomplished by initializing one or more adjustable parameter(s) of the viscosity model, calculating viscosity with the viscosity model, comparing the difference between the calculated viscosity to corresponding measured viscosity, and updating the parameter(s) if the difference is greater than a predetermined error tolerance threshold. If the difference is less than (or equal to) the predetermined error tolerance threshold, then the tuning is finished. For example, for the Pal-Rhodes model, the adjustable parameters that are tuned can include the parameter K' and the exponent parameter v. In another example, for the Mooney model, the adjustable parameters that are tuned can include the parameter [η] and the parameter $A_{max}$.

After step 267, the operations continue step 281.

In step 271, no suitable match has been found between the solubility curves and the measured properties. In this case, the operations can determine if there is a need for additional measurement stations and/or different methodologies for repeat processing and analysis in order to improve the confidence level of the measured and/or predicted fluid properties. For example, the measured and/or predicted properties of the reservoir fluid can be compared to a database of historical reservoir data to determine the measured and/or predicted properties make sense. If the data does not make sense, additional measurement station(s) or different methodologies (e.g., different model(s)) can be identified for repeat processing and analysis in order to improve the confidence level of the measured and/or predicted fluid properties.

Other factors can be used to determine if there is a need for additional measurement stations and/or different methodologies for repeat processing and analysis in order to improve the confidence level of the measured and/or predicted fluid properties. For example, in step 271, it is expected that the reservoir is compartmentalized or not in thermodynamic equilibrium. Thus, the measured fluid properties can be accessed to confirm that they correspond to this expected architecture.

If in step 271 there is a need for additional measurement stations and/or different methodologies, the operations can continue to step 273 to repeat the appropriate processing and analysis in order to improve the confidence level of the measured and/or predicted fluid properties.

If in step 271, there is no need for additional measurement stations and/or different methodologies (in other words, there is sufficient confidence level in the measured and/or predicted fluid properties), the operation continues to step 275 where the reservoir architecture is declared to be compartmentalized and/or not in thermodynamic equilibrium. Such a determination is supported by the invalidity of the assumptions of reservoir connectivity and thermal equilibrium that underlie the models utilized for predicting the solute part property gradient within the wellbore.

Subsequent to the determination of reservoir architecture in steps 253, 257, 261, 265, and 275, the results of such determination are reported to interested parties in step 281. The characteristics of the reservoir architecture reported in step 281 can be used to model and/or understand the reservoir of interest for reservoir assessment, planning and management.

In another embodiment, the operations of steps 205 to 263 can be substituted by operations that model the fluid properties of the reservoir utilizing a particular equation of state model, referred to herein as the FHZ EOS model. The FHZ EOS model is described in detail in International Patent Application Publication WO 2012/042397, herein incorporated by reference in its entirety. The FHZ EOS model derives compositional gradients as well as other property gradients (e.g., pressure and temperature gradients) that describe the volumetric behavior of the oil and gas (and possibly water) mixture in reservoir fluids as a function of depth in the reservoir of interest. The compositional gradients derived from the FHZ EOS model preferably include mass fractions, mole fractions, molecular weights, and specific gravities for a set of pseudocomponents of the formation fluid. Preferably, such pseudocomponents include a heavy pseudocomponent representing asphaltenes in the formation fluid, a second distillate pseudocomponent that represents the non-asphaltene liquid fraction of the formation fluid, and a third light pseudocomponent that presents gases in the formation fluid. The pseudocomponents derived from the FHZ EOS model can also represent single carbon number (SCN) components as well as other fractions or lumps of the formation fluid (such as a water fraction) as desired. The FHZ EOS model can predict composition gradients with depth that take into account the impacts of gravitational forces, chemical forces, thermal diffusion, etc.

as taught in International Patent Application Publication WO 2011/007268, herein incorporated by reference in its entirety. Other applications of the FHZ EOS have been described in U.S. Pat. Nos. 7,920,970; 7,822,554; 7,996,154; and 8,271,248; U.S. Patent Application Publication US 2009/0312997; and International Patent Application Publications WO 2009/138911; WO 2011/030243; WO 2012/042397; and WO 2011/138700, all herein incorporated by reference in their entireties. For some cases, one or more terms of the FHZ EOS model dominate and the other terms can be ignored. For example, in low GOR black oils, the gravity term of the FHZ EOS model dominates and the term related to chemical forces (solubility) and thermal diffusion (entropy) can be ignored.

The FHZ EOS model employs an equation of state together with flash calculations to predict compositions (including asphaltene) as a function of depth in the reservoir. The equation of state represents the phase behavior of the compositional components of the reservoir fluid. Such equation of state can take many forms. For example, it can be any one of many cubic EOS as is well known. Such cubic EOS include van der Waals EOS (1873), Redlich-Kwong EOS (1949), Soave-Redlich Kwong EOS (1972), Peng-Robinson EOS (1976), Stryjek-Vera-Peng-Robinson EOS (1986) and Patel-Teja EOS (1982). Volume shift parameters can be employed as part of the cubic EOS in order to improve liquid density predictions as is well known. Mixing rules (such as van der Waals mixing rule) can also be employed as part of the cubic EOS. A SAFT-type EOS can also be used as is well known in the art. The equation of state is extended to predict compositional gradients (including an asphaltene compositional gradient) with depth that take into account the impacts of gravitational forces, chemical forces, thermal diffusion, etc. The flash calculations solve for fugacities of components that form at equilibrium.

The asphaltene compositional gradient produced by the FHZ EOS model can be compared to asphaltene concentrations measured by downhole fluid analysis to derive a profile of asphaltene pseudocomponents (e.g., asphaltene nanoaggregates and larger asphaltene clusters) and corresponding aggregate size and molecular weight of asphaltenes as a function of depth in the reservoir of interest as taught in International Patent Application Publication WO 2011/007268. The profile of the asphaltene pseudocomponents can be used to characterize the reservoir fluids. For example, the profile of the asphaltene pseudocomponents of the reservoir fluids can be used to determine that the reservoir fluids include asphaltene clusters (similar to step 263) and then continue to operations similar to steps 265 and 267 where a viscosity model suitable for heavy oil is used to characterize the viscosity of the oil column.

The computational analysis described herein can be carried out in real time with associated downhole fluid analysis, or post job (subsequent to associated downhole fluid analysis) or prejob (prior to downhole fluid analysis).

The fluid analysis of the reservoir fluids can be performed at downhole measurement stations within the wellbore by downhole fluid analysis tools as described herein. It is also possible for downhole tools to collect live oil samples of the reservoir fluids. Fluid analysis of such samples can be performed in a laboratory to measure dead oil and live oil properties of the samples as is well known. Such properties can include live fluid density ($\rho$), live fluid viscosity ($\mu$), concentrations (e.g., weight percentages) of single carbon components and pseudocomponents of the reservoir fluids (such as carbon dioxide ($CO_2$), methane ($CH_4$), ethane ($C_2H_6$), the C3-C5 alkane group, the lump of hexane and heavier alkane components (C6+), and asphaltene content), GOR, and possibly other parameters (such as API gravity, oil formation volume factor ($B_0$), etc.). The output of such laboratory fluid analysis can be used to characterize the reservoir fluids as part of the workflow of the present application.

The computational models and computational analysis described herein can also be integrated into reservoir simulation systems in order to predict fluid properties of the reservoir fluid during production. For example, the predictions of viscosity of the reservoir fluids as well as the viscosity model (and/or related parameters) can be integrated into a reservoir simulation system to simulate, plan, and execute enhanced production processes for heavy oil.

There have been described and illustrated herein embodiments of a method for analysis of the fluid properties (particularly viscosity) of a reservoir of interest and for characterizing the reservoir of interest based upon such analysis. While particular equations of state models, solubility models, and applications of such models have been disclosed for predicting properties of reservoir fluid, it will be appreciated that other such models and applications thereof could be used as well. Moreover, the methodology described herein is not limited to stations in the same wellbore. For example, measurements from samples from different wells can be analyzed as described herein for testing for lateral connectivity. In addition, the workflow as described herein can be modified. For example, it is contemplated that other solute part classes (such as a solute class type including both asphaltene nanoaggregates and asphaltene clusters) can be defined. In another example, user input can select the solute type classes from a list of solute type classes for processing. The user might also be able to specify certain parameters for the processing, such as diameters that are used as input to the solubility model to derive concentration curves for the relevant solute part classes as well as optical density wavelengths that are used to correlate such concentrations to concentrations measured by downhole fluid analysis. It will therefore be appreciated by those skilled in the art that yet other modifications could be made to the disclosed embodiments without deviating from its scope as claimed.

What is claimed is:

1. A method for characterizing petroleum fluid in a reservoir traversed by at least one wellbore, the method comprising:

(a) for at least one location within the at least one wellbore, acquiring, with a downhole tool, at least one fluid sample at the location;

(b) performing fluid analysis of the fluid sample(s) acquired in (a) to measure properties of the fluid sample(s), the properties including asphaltene concentration;

(c) using at least one model that predicts asphaltene concentration as a function of location in the reservoir to determine a predicted asphaltene concentration, wherein the at least one model that predicts asphaltene concentration as a function of location in the reservoir is not tuned;

(d) identifying a particular asphaltene type based at least in part on a comparison between the predicted asphaltene concentration as derived in (c) and the corresponding concentration(s) measured by the fluid analysis in (b) for corresponding location(s) in the wellbore, wherein the particular asphaltene type comprises resins, asphaltene nanoaggregates, asphaltene clusters, or any combination thereof; and (e) identifying a viscosity of one or more fluids in the reservoir as a function of location in the reservoir based at least in part on the identified particular asphaltene type and by tuning a viscosity model, wherein the viscosity model allows for gradients in the viscosity of the reservoir fluids as a function of depth, wherein the viscosity model is supplied to a reservoir simulator for simulation analysis of production of the reservoir, and wherein the reservoir simulator is configured to generate a production plan for the reservoir based on the viscosity model, wherein the viscosity model models viscosity of a mixture as a function of one or more pseudo-critical properties of the mixture and one or more properties of the mixture, the one or more properties comprising a molecular weight of the mixture, wherein tuning the viscosity model comprises:

tuning the one or more pseudo-critical properties of the viscosity model based at least in part upon a viscosity of a fluid sample measured by fluid analysis and a location associated with the fluid sample measured by fluid analysis, and tuning the one or more properties based on the one or more tuned pseudo-critical properties, and wherein the at least one model that predicts asphaltene concentration as a function of location in the reservoir and the viscosity model are different models; and (f) determine if additional measurement stations, different methodologies, or combinations thereof are needed to increase a confidence level of measured properties, predicted properties, or combinations thereof, wherein:

(1) if it is determined that additional measurement stations, different methodologies, or combinations thereof are needed to increase a confidence level of measured properties, predicted properties, or combinations thereof repeating the foregoing processing for one or more additional measurement stations, different methodologies, or combinations thereof; or (2) if it is determined that additional measurement stations, different methodologies, or combinations thereof are not needed to increase a confidence level of measured properties, predicted properties, or combinations thereof, determining if there is a continuous increase of fluid viscosity as a function of depth or if there is a discontinuous fluid viscosity as a function of depth, wherein:

if there is a continuous increase of fluid viscosity as a function of depth a declaration of connectivity is made and a declaration of a reservoir architecture that is non-compartmentalized is reported to interested parties; or if there is a discontinuous fluid viscosity as a function of depth a declaration of a reservoir architecture that is compartmentalized is made and is reported to interested parties.

2. A method according to claim 1, wherein the viscosity model of (e) comprises a corresponding state principle model of viscosity, wherein the corresponding state principle model of viscosity models viscosity of a mixture based upon corresponding states theory to predict viscosity of the mixture as a function of temperature, pressure, composition of the mixture, the one or more pseudo-critical properties of the mixture, and the viscosity of a reference fluid evaluated at a reference pressure and temperature.

3. A method according to claim 2, wherein the corresponding state principle model of viscosity has the form:

$$\mu_m(P,T)=\left(\frac{T_{cm}}{T_{co}}\right)^{-\frac{1}{6}}\left(\frac{P_{cm}}{P_{co}}\right)^{\frac{2}{3}}\left(\frac{MW_m}{MW_o}\right)^{\frac{1}{2}}\left(\frac{\alpha_m}{\alpha_o}\right)\mu_0(P_o,T_o)$$

where_$\mu_m$(P, T) is the viscosity of the mixture;

$\mu_0(P_0, T_o)$ is the viscosity of the reference fluid at a reference temperature and reference pressure;

$T_{cm}$ is the critical temperature of the mixture;

$T_{co}$ is the critical temperature of the reference fluid;

$P_{cm}$ is the critical pressure of the mixture;

$P_{co}$ is the critical pressure of the reference fluid;

$MW_m$ is the molecular weight of the mixture; and $MW_o$ is the molecular weight of the reference fluid;

$\alpha_m$ is a parameter for the mixture; and $\alpha_0$ is a parameter for the reference fluid.

4. A method according to claim 3, wherein the viscosity model is based on a parameter representing molecular weight of the mixture, wherein the parameter representing molecular weight of the mixture is set in a range less than 60,000 g/mol.

5. A method according to claim 4, wherein the parameter representing molecular weight of the mixture is set in a range between 1500 and 3000 g/mol.

6. A method according to claim 3, wherein:

$$\alpha_m=1.000+7.378*10^{-3}\rho_{ro}^{1.847}MW_m^{0.5173}$$

$$\alpha_0=1.000+0.31\rho_{ro}^{1.847}$$

the parameter $\rho_{ro}$ is the reduced density of the reference fluid evaluated at a reference pressure and temperature as indicated in the following:

$$\rho_{ro}=\frac{\rho_0}{\rho_{co}},$$

$\rho_o$ is the density of the reference fluid at the reference temperature and pressure, and $\rho_{co}$ is the critical density of the reference fluid.

7. A method according to claim 1, wherein the at least one model of (c) includes an equation of state model that predicts compositional properties and fluid properties at different locations within the reservoir based on the fluid properties measured in (b).

8. A method according to claim 7, wherein the at least one model of (c) further includes a solubility model that characterizes relative concentrations of a set of high molecular weight components as a function of depth as related to relative solubility, density, and molar volume of the high molecular weight components of the set at varying depth, where the set of high molecular weight components include asphaltene components, and wherein the compositional and fluid properties predicted by the equation of state model are used as inputs to the solubility model.

9. A method according to claim 8, wherein the solubility model treats the reservoir fluid as a mixture of two parts, the two parts being a solute part and a solvent part, the solute part comprising the set of high molecular weight components.

10. A method according to claim 9, wherein the high molecular weight components of the solute part are defined by a class type and selected from the group including resins, asphaltene nanoaggregates, and asphaltene clusters.

11. A method according to claim 9, wherein the relative concentration of the solute part as a function of depth is given by:

$$\frac{\phi_i(h_2)}{\phi_i(h_1)} = \exp\left\{\frac{v_i g(\rho_m - \rho_i)(h_2 - h_1)}{RT} + \left(\frac{v_i}{v_m}\right)_{h_2} - \left(\frac{v_i}{v_m}\right)_{h1} - \frac{v_i\left[(\delta_i - \delta_m)^2_{h_2} - (\delta_i - \delta_m)^2_{h_1}\right]}{RT}\right\},$$

wherein:

$\phi_i(h_1)$ is the volume fraction for the solute part at depth $h_1$,
$\phi_i(h_2)$ is the volume fraction for the solute part at depth $h_2$,
$v_i$ is the partial molar volume for the solute part,
$v_m$ is the molar volume for the solution,
$\delta_i$ is the solubility parameter for the solute part,
$\delta_m$ is the solubility parameter for the solution,
$\rho_i$ is the partial density for the solute part,
$\rho_m$ is the density for the solution,
R is the universal gas constant,
T is the absolute temperature of the reservoir fluid, and
g is the gravitational constant.

12. A method according to claim 9, wherein the relative concentration of the solute part as a function of depth is given by:

$$\frac{\phi_i(h_2)}{\phi_i(h_1)} = \exp\left\{\frac{v_i g(\rho_m - \rho_i)(h_2 - h_1)}{RT}\right\},$$

wherein:

$\phi_i(h_1)$ is the volume fraction for the solute part at depth $h_1$,
$\phi_i(h_2)$ is the volume fraction for the solute part at depth $h_2$,
$v_i$ is the partial molar volume for the solute part,
$\rho_i$ is the partial density for the solute part,
$\rho_m$ is the density for the solution,
R is the universal gas constant,
T is the absolute temperature of the reservoir fluid, and
g is the gravitational constant.

13. A method according to claim 1, wherein the at least one model of (c) includes an equation of state model that includes concentrations, molecular weights, and specific gravities for a set of pseudocomponents of the formation fluid, wherein such pseudocomponents include a heavy pseudocomponent representing asphaltenes in the reservoir fluid, a second distillate pseudocomponent that represents the non-asphaltene liquid fraction of the reservoir fluid, and a third light pseudocomponent that represents gases in the reservoir fluid.

14. A method according to claim 1, wherein the viscosity model is extended to account for the effect of GOR, pressure, and temperature on viscosity.

15. A method according to claim 1, wherein the fluid analysis of (b) is performed by a downhole fluid analysis tool.

16. A method according to claim 1, wherein the fluid analysis of (b) is performed by a laboratory fluid analysis tool.

17. The method of claim 1, wherein tuning one or more pseudo-critical properties of the viscosity model based at least in part upon a viscosity of a fluid sample measured by fluid analysis and a location associated with the fluid sample measured by fluid analysis comprises:

calculating an initial viscosity based on an initial value of the one or more pseudo-critical properties;

determining a difference between the initial viscosity and the viscosity of the fluid sample; and determining the one or more tuned pseudo-critical properties based at least in part on the difference.

18. The method of claim 17, wherein tuning one or more pseudo-critical properties of the viscosity model based at least in part upon a viscosity of a fluid sample measured by fluid analysis and a location associated with the fluid sample measured by fluid analysis comprises:

modifying the one or more tuned pseudo-critical properties based at least in part on empirical data associated with a reference fluid to generate one or more modified pseudo-critical properties; and determining the molecular weight of the mixture based on the one or more modified pseudo-critical properties.

19. A method according to claim 1, wherein:

the at least one model of (c) includes an equation of state model that predicts compositional properties and fluid properties at different locations within the reservoir based on the fluid properties measured in (b), the at least one model of (c) further includes a solubility model that characterizes relative concentrations of a set of high molecular weight components as a function of depth as related to relative solubility, density, and molar volume of the high molecular weight components of the set at varying depth, the set of high molecular weight components include asphaltene components, the compositional properties and the fluid properties predicted by the equation of state model are used as inputs to the solubility model, the solubility model treats the reservoir fluid as a mixture of two parts, the two parts being a solute part and a solvent part, the solute part comprising the set of high molecular weight components, the relative concentration of the solute part as a function of depth is given by:

$$\frac{\phi_i(h_2)}{\phi_i(h_1)} = \exp\left\{\frac{v_i g(\rho_m - \rho_i)(h_2 - h_1)}{RT} + \left(\frac{v_i}{v_m}\right)_{h_2} - \left(\frac{v_i}{v_m}\right)_{h1} - \frac{v_i\left[(\delta_i - \delta_m)^2_{h_2} - (\delta_i - \delta_m)^2_{h_1}\right]}{RT}\right\},$$

wherein:

$\phi_i(h_1)$ is the volume fraction for the solute part at depth $h_1$,
$\phi_i(h_2)$ is the volume fraction for the solute part at depth $h_2$,
$v_i$ is the partial molar volume for the solute part,
$v_m$ is the molar volume for the solution,
$\delta_i$ is the solubility parameter for the solute part,
$\delta_m$ is the solubility parameter for the solution,
$\rho_i$ is the partial density for the solute part,
$\rho_m$ is the density for the solution,
R is the universal gas constant,
T is the absolute temperature of the reservoir fluid, and
g is the gravitational constant, the viscosity model of (e) comprises a corresponding state principle model of viscosity, the corresponding state principle model of viscosity models viscosity of a mixture based upon corresponding states theory to predict viscosity of the mixture as a function of temperature, pressure, composition of the mixture, the one or more pseudo-critical properties of the mixture, and the viscosity of a reference fluid evaluated at a reference pressure and temperature, and the corresponding state principle model of viscosity has the form:

$$\mu_m(P, T) = \left(\frac{T_{cm}}{T_{co}}\right)^{-\frac{1}{6}}\left(\frac{P_{cm}}{P_{co}}\right)^{\frac{2}{3}}\left(\frac{MW_m}{MW_o}\right)^{\frac{1}{2}}\left(\frac{\alpha_m}{\alpha_o}\right)\mu_0(P_o, T_o),$$

wherein:

$\mu_m(P, T)$ is the viscosity of the mixture;

$\mu_0(P_o, T_o)$ is the viscosity of the reference fluid at a reference temperature and reference pressure;

$T_{cm}$ is the critical temperature of the mixture;

$T_{co}$ is the critical temperature of the reference fluid;

$P_{cm}$ is the critical pressure of the mixture;

$P_{co}$ is the critical pressure of the reference fluid;

$MW_m$ is the molecular weight of the mixture;

$MW_o$ is the molecular weight of the reference fluid;

$\alpha_m$ is a parameter for the mixture; and $\alpha_0$ is a parameter for the reference fluid.

20. A method according to claim 19, wherein:

$$\alpha_m=1.000+7.378*10^{-3}\rho_{ro}^{1.847}MW_m^{0.5173}$$

$$\alpha_0=1.000+0.31\rho_{ro}^{1.847}$$

the parameter $\rho_{ro}$ is the reduced density of the reference fluid evaluated at a reference pressure and temperature as indicated in the following:

$$\rho_{ro} = \frac{\rho_0}{\rho_{co}},$$

$\rho_o$ is the density of the reference fluid at the reference temperature and pressure, and $\rho_{co}$ is the critical density of the reference fluid.

21. A method for characterizing petroleum fluid in a reservoir traversed by at least one wellbore, the method comprising:

(a) determining a concentration of a set of components of the petroleum fluid as a function of depth in the reservoir with at least one model, wherein the set of components includes at least one asphaltene component, wherein the at least one model that predicts components of the petroleum fluid as a function of depth in the reservoir is not tuned, (b) determining whether the least one asphaltene component of the petroleum fluid corresponds to a particular asphaltene type, wherein the particular asphaltene type comprises resins, asphaltene nanoaggregates, asphaltene clusters, or any combination thereof;

(c) identifying a viscosity of one or more fluids in the reservoir as a function of location in the reservoir based at least in part on the identified particular asphaltene type and by tuning a viscosity model, wherein the viscosity model allows for gradients in the viscosity of the petroleum fluids as a function of depth, wherein the viscosity model is supplied to a reservoir simulator for simulation analysis of production of the reservoir, and wherein the reservoir simulator is configured to generate a production plan for the reservoir based on the viscosity model, wherein the viscosity model models viscosity of a mixture as a function of one or more pseudo-critical properties of the mixture and one or more properties of the mixture, the one or more properties comprising a molecular weight of the mixture, wherein tuning the viscosity model comprises:

tuning the one or more pseudo-critical properties of the viscosity model based at least in part upon a viscosity of a fluid sample measured by fluid analysis and a location associated with the fluid sample measured by fluid analysis, and tuning the one or more properties based on the one or more tuned pseudo-critical properties, and wherein the at least one model and the viscosity model are different models;

(d) determine if additional measurement stations, different methodologies, or combinations thereof are needed to increase a confidence level of measured properties, predicted properties, or combinations thereof, wherein:

(1) if it is determined that additional measurement stations, different methodologies, or combinations thereof are needed to increase a confidence level of measured properties, predicted properties, or combinations thereof repeating the foregoing processing for one or more additional measurement stations, different methodologies, or combinations thereof; or (2) if it is determined that additional measurement stations, different methodologies, or combinations thereof are not needed to increase a confidence level of measured properties, predicted properties, or combinations thereof, determining if there is a continuous increase of fluid viscosity as a function of depth or if there is a discontinuous fluid viscosity as a function of depth, wherein:

if there is a continuous increase of fluid viscosity as a function of depth a declaration of connectivity is made and a declaration of a reservoir architecture that is non-compartmentalized is reported to interested parties, or if there is a discontinuous fluid viscosity as a function of depth a declaration of a reservoir architecture that is compartmentalized is made and is reported to interested parties.

22. A method according to claim 21, wherein the viscosity model of (c) comprises a corresponding state principle model of viscosity, wherein the corresponding state principle model of viscosity models viscosity of a mixture based upon corresponding states theory to predict viscosity of the mixture as a function of temperature, pressure, composition of the mixture, the one or more pseudo-critical properties of the mixture, and the viscosity of a reference fluid evaluated at a reference pressure and temperature.

23. A method according to claim 22, wherein the corresponding state principle model of viscosity has the form:

$$\mu_m(P, T) = \left(\frac{T_{cm}}{T_{co}}\right)^{-\frac{1}{6}}\left(\frac{P_{cm}}{P_{co}}\right)^{\frac{2}{3}}\left(\frac{MW_m}{MW_o}\right)^{\frac{1}{2}}\left(\frac{\alpha_m}{\alpha_o}\right)\mu_0(P_o, T_o)$$

where $\mu_m(P, T)$ is the viscosity of the mixture;

$\mu_0(P_0, T_o)$ is the viscosity of the reference fluid at a reference temperature and reference pressure;

$T_{cm}$ is the critical temperature of the mixture;

$T_{co}$ is the critical temperature of the reference fluid;

$P_{cm}$ is the critical pressure of the mixture;

$P_{co}$ is the critical pressure of the reference fluid;

$MW_m$ is the molecular weight of the mixture; and $MW_o$ is the molecular weight of the reference fluid;

$\alpha_m$ is a parameter for the mixture; and $\alpha_0$ is a parameter for the reference fluid.

24. A method according to claim 23, wherein the viscosity model is based on a parameter representing molecular weight of the mixture, wherein the parameter representing molecular weight of the mixture is set in a range less than 60,000 g/mol.

25. A method according to claim 23, wherein the parameter representing molecular weight of the mixture is set in a range between 1500 and 3000 g/mol.

* * * * *